US007837304B2

(12) United States Patent
Eguchi et al.

(10) Patent No.: US 7,837,304 B2
(45) Date of Patent: Nov. 23, 2010

(54) LIQUID DISCHARGING DEVICE

(75) Inventors: Takeo Eguchi, Kanagawa (JP); Kazuyasu Takenaka, Tokyo (JP); Shin Todo, Tokyo (JP); Atsushi Nakamura, Kanagawa (JP); Iwao Ushinohama, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/574,738

(22) PCT Filed: Oct. 7, 2004

(86) PCT No.: PCT/JP2004/015207

§ 371 (c)(1),
(2), (4) Date: Jan. 16, 2007

(87) PCT Pub. No.: WO2005/035254

PCT Pub. Date: Apr. 21, 2005

(65) Prior Publication Data

US 2007/0211106 A1 Sep. 13, 2007

(30) Foreign Application Priority Data

Oct. 7, 2003 (JP) ..... 2003-348709

(51) Int. Cl.
*B41J 2/05* (2006.01)
*B41J 2/04* (2006.01)

(52) U.S. Cl. ..... 347/65; 347/54

(58) Field of Classification Search ..... 347/65, 347/54

See application file for complete search history.

(56) References Cited

U.S. PATENT DOCUMENTS 5,697,144 A * 12/1997 Mitani et al. ..... 29/611
6,170,931 B1 1/2001 Anderson et al.
2002/0152607 A1 10/2002 Komplin et al.
2002/0167568 A1 11/2002 Sakuma

FOREIGN PATENT DOCUMENTS

EP 0 500 068 8/1992

(Continued)

*Primary Examiner*—Stephen D Meier
*Assistant Examiner*—Geoffrey Mruk
(74) *Attorney, Agent, or Firm*—Robert J. Depke; Rockey, Depke & Lyons, LLC

(57) ABSTRACT

The present invention is a liquid discharge device having a function of supplying liquid to liquid chambers in a stable manner, and also has a function of suppressing interference between liquid discharge portions due to discharging of liquid droplets. The liquid discharge device has a liquid discharge head in which a plurality of liquid discharge portions including an ink liquid chamber (12) for storing a liquid to be discharged, and nozzles (18) for discharging the liquid stored in the ink liquid chamber (12), are arrayed on a substrate. The liquid discharge device comprises: individual channels (20) provided for each of the liquid discharge portions so as to communicate with the ink liquid chamber (12) and supply liquid to within the ink liquid chamber (12); and a common channel (30) which is provided to the plurality of individual channels (20) so as to communicate with each of the plurality of individual channels (20), for supplying liquid to the plurality of individual channels (20). The common channel (30) includes a first common channel (31) provided on a liquid supply source side, and a second common channel (32) provided adjacent to the individual channels (20), and having liquid channel resistance greater than that of the first common channel (31).

17 Claims, 21 Drawing Sheets

FOREIGN PATENT DOCUMENTS

| | | |
|---|---|---|
| EP | 1 312 478 | 5/2003 |
| JP | 63-019263 | 1/1988 |
| JP | 64-090754 | 4/1989 |
| JP | 03-234628 | 10/1991 |
| JP | 6-312506 | 11/1994 |
| JP | 11-078015 | 3/1999 |
| JP | 2000-158657 | 6/2000 |
| JP | 2001-353875 | 12/2001 |
| JP | 2002-326354 | 11/2002 |
| JP | 2003-025579 | 1/2003 |
| JP | 2003-127363 | 5/2003 |

* cited by examiner

FIG. 8 unit : [μm]

| PROTOTYPE NO | (A) | (B) | (C) | PERPENDICULAR COMMON CHANNEL 32d | | (E) | (F) | PILLARS 32b IN HORIZONTAL COMMON CHANNEL 32c |
|---|---|---|---|---|---|---|---|---|
| | | | | WIDTH (D) | LENGTH (L) | | | |
| SS207 | 12 | 11 | 650 | 455 | 650 | 1400 | 1200 | INCLUDING |
| SS941 | | | | 256 | | | | |
| SS1062 | | | | 256 | | | | |
| SS1083 | | | | 256 | | | | NOT INCLUDING |

LIQUID DISCHARGING DEVICE

This application is a 371 U.S. National Stage filing of PCT/JP2004/015207, filed Oct. 7, 2004, which claims priority to Japanese Patent Application Number 2003-348709, filed Oct. 7, 2003, both of which are incorporated herein by reference.

TECHNICAL FIELD

The present invention relates to a channel structure for liquid in a liquid discharge device for discharging liquid within a liquid chamber from nozzles, and more particularly relates to a technique for reducing the effects of pressure fluctuation at the time of discharging liquid droplets by providing multiple common channels with differing channel resistances.

BACKGROUND ART

A known example of a conventional ink channel structure in an ink jet printer which is a liquid discharge device is that disclosed in FIG. 4 of Japanese Unexamined Patent Application Publication No. 2003-136737.

Specifically, the above Japanese Unexamined Patent Application Publication No. 2003-136737 discloses an arrangement wherein an ink channel is formed of a channel plate such so as to communicate with an ink pressurization chamber.

With the above configuration, the entrance portion of the ink pressurization chamber is formed such that each ink pressurization chamber has its own channel. Also, the ink channel forms a common channel for supplying ink to each of the individual channels for all of the ink pressurization chambers.

FIG. 17 is a diagram schematically illustrating the individual channels and common channel, and the ink liquid chamber (synonymous with the ink pressurization chamber in the above Japanese Unexamined Patent Application Publication No. 2003-136737), describing the actions at the time of discharging ink (arrows in the drawing indicate the movement of ink) in time sequence. In FIG. 17, an ink liquid chamber a, individual channel b, and common channel c are arranged communicably, formed such that the ink can flow (be supplied) from the common channel c→individual channel b→ink liquid chamber.

Further, provided within the ink liquid chamber a is a heating element d, for discharging ink within the ink liquid chamber. In the event that the heating element d is provided on the base of the ink liquid chamber a, normally, a nozzle e is situated on the upper face of the ink liquid chamber a, but in FIG. 17, the nozzle e is illustrated to the right side of the ink liquid chamber a, for the sake of simplifying of the drawing.

First, in the "(1) stationary" state in the drawing, the ink liquid chamber a is filled with ink.

At the time of discharging ink, i.e., in the "(2) expansion" state, the heating element d is rapidly heated, generating a bubble within the ink liquid chamber a. Generating this bubble gives the ink within the ink liquid chamber a flying power, and a part of the ink within the ink liquid chamber a is discharged from the nozzle e as an ink droplet due to the flying power.

Immediately following the above "(2) expansion" state, heating of the heating element d ends. Also, the bubble within the ink liquid chamber a dissipates upon the ink droplet being discharged, so transition is made to the next "(3) contraction", where the inside of the ink liquid chamber a is depressurized. Further, in the following "(4) replenishing" state, ink of an amount equivalent to that of the discharged ink droplet is replenished to the ink liquid chamber a via the common channel c and the individual channel b.

As described above, the actions of a stationary state, and then expansion, contraction, and replenishing, are repeated when discharging ink.

Now, while gasoline engines, for example, use intake and exhaust valves synchronized with the rotations of the engine, with internal combustion occurring in a state wherein both valves are completely closed, the ink jet printer head shown in FIG. 17 has nothing equivalent to the valves of a gasoline engine.

Accordingly, in order to cause the energy applied to the heating element d to efficiently discharge ink droplets, there is need for expansion of ink to occur in the direction of the nozzle e (toward the right in FIG. 17) as much as possible. In other words, reducing the amount of ink escaping to the individual channel b side (toward the left in FIG. 17) opposite to the nozzle e side at the time of expansion as much as possible will improve the discharge efficiency.

However, with the above-described related art, there is the problem that at the time of expansion by heating the heating element d, a shock wave due to the pressurization is propagated from within the ink liquid chamber a to the individual channel b, and further on to the common channel c side. Also, there is the problem that at the time of contraction, a shock wave due to depressurization is generated through the individual channel b.

FIG. 18 is a diagram illustrating the mutual interference states of shock waves in the stationary, expansion, contraction, and replenishing states shown in FIG. 17.

As shown in FIG. 18, at the time of expansion, a pressurization shock wave occurs at the individual channel b side from the ink liquid chamber a, in addition to that in the discharge direction of the nozzle e. Also, at the time of contraction, a depressurization shock wave due to retraction of the ink to the ink liquid chamber a side from the individual channel b side occurs. It is estimated that these pressurization shock wave and depressurization shock wave affect even the common channel c. Such shock waves affect ink liquid chambers a adjacent to the ink liquid chamber a which has performed the discharging action. For example, in the event that a pressurization shock wave reaches an adjacent ink liquid chamber a, the pressure within that ink liquid chamber a increases. Also, in the event that a depressurization shock wave reaches an adjacent ink liquid chamber a, the pressure within that ink liquid chamber a decreases.

FIG. 19 is a diagram for describing the relation between the pressure within the ink liquid chamber a and the discharged ink droplet. FIG. 19 illustrates, from top down in sequential order, the states of when stationary, when generating a bubble, when the bubble is dissipating, and when the ink droplet is being discharged. Also, in the drawing, the left-side column (A-1) indicates a case wherein the pressure within the ink liquid chamber a is smaller than a suitable value (pressure<suitable value), the middle column (A-2) indicates a case wherein the pressure within the ink liquid chamber a is at the suitable value (pressure=suitable value), and the right-side column (A-3) indicates a case wherein the pressure within the ink liquid chamber a is greater than the suitable value (pressure>suitable value).

As shown in FIG. 19, in the event that the pressure within the ink liquid chamber a is at the suitable value, the meniscus of the ink droplet prior to discharge (when stationary) is concaved as to the discharging face of the nozzle e, with the pressure within the ink liquid chamber a being balanced against the surface tension acting upon the nozzle edge and the external air pressure, thereby maintaining a suitable position.

In the event that the pressure within the ink liquid chamber a changes, the amount of ink within the ink liquid chamber a changes accordingly, so the amount of the ink droplet discharge changes. That is to say, in the event that the pressure within the ink liquid chamber a is low, the amount of the ink droplet discharge is smaller, as shown in the left-side column (A-1) in the drawing. On the other hand, in the event that the pressure within the ink liquid chamber a is high, the amount of the ink droplet discharge is greater, as shown in the right-side column (A-3) in the drawing.

Changes in the amount of the ink droplet discharged changes in this way are manifested in the results of the ink droplets landing as change in ink density (density irregularities).

FIG. 20 is a graph representation of the results of performing ink droplet discharge with an ink jet printer line head manufactured for 600 dpi, and measuring change in density of the discharged ink as change (volume/weight) in the ink droplets. In the drawing, the horizontal axis represents the nozzle position, and the vertical axis represents the density (the higher in this drawing, the darker the color). With this example, portions where one dot is recorded for each pixel over 32 nozzles, and portions where no ink droplets are discharged (blank; white areas), are arrayed in an alternating manner.

Also, the upper part of FIG. 21 illustrates how the change in density appears for the portion in FIG. 20 surrounded by the single-dot broken line in the form of contrasting densities, by showing lightness information alone. Also, the lower part of FIG. 21 illustrates an ideal state wherein no change due to pressure fluctuation occurs, as a reference value, at the average density value (160) of the upper half.

The data shown in FIG. 20 and the diagram at the upper part of FIG. 21 do not represent instantaneous changes which actually occur, and were created by averaging data of each nozzle e recording over a certain length (actually, discharge was performed once per pixel, over a length of 196 pixels which is approximately 25 mm, by discharging 196 times).

It can be understood from this diagram that, regardless of averaging over a long period, the property of each nozzle e does not stay around the density of 160 but rather fluctuates widely, i.e., that standing waves are present. Further, the fact that such visible fluctuations remain even for average values can be thought to mean that even greater fluctuations occur on an instantaneous level.

An example of a conceivable method to suppress manifestation of density irregularities due to the effects of shock waves occurring at the time of discharging ink droplets and the air bubble contracting as described above, is to, firstly, make the individual flow channel b narrower (make the cross-sectional area of the channel smaller), or secondly, not make the individual flow channel b narrower but longer.

These methods can reduce interference among the ink liquid chambers due to discharge, thereby reducing irregularities in the amount of ink droplets discharged therefrom.

However, the above methods have problems in that the time for replenishing (refilling) the ink liquid chamber a with ink following discharge of the ink droplet takes longer due to increased channel resistance of the individual channel b. Also, making the individual channel b narrower means that undesired matter, dust, and the like, can become stuck therein just that much more readily, incapacitating ink discharge. Further, the above second method (method of forming the individual channel b longer) has the problem that the head increases in size.

Accordingly, the problems to be solved by the present invention is to reduce the effects of shock waves and to reduce the difference in density among the discharged ink droplets, without extending the refill time, without increasing the risk of faulty discharge due to undesired matter and dust and the like, and without increasing the size of the head.

DISCLOSURE OF INVENTION

The present invention solves the above problems with the following solving means.

The present invention is a liquid discharge device having a liquid discharge head in which a plurality of liquid discharge portions including a liquid chamber for storing a liquid to be discharged, flying force supplying means disposed within the liquid chamber, for providing the liquid within the liquid chamber with flying force, and a nozzle formation member forming a nozzle for discharging the liquid stored in the liquid chamber by actions of the flying force supplying means, are arrayed on a substrate, the liquid discharge device comprising: individual channels provided for each of the liquid discharge portions so as to communicate with the liquid chamber and supply liquid to within the liquid chamber; and a common channel which is provided to the plurality of individual channels so as to communicate with each of the plurality of individual channels, for supplying liquid to the plurality of individual channels; the common channel including a first common channel provided on a liquid supply source side, and a second common channel provided adjacent to the individual channels, and having liquid channel resistance greater than that of the first common channel.

With the present invention, at the time of ink being supplied from the liquid supply source, the ink is supplied from the first common channel to the individual channels through the second common channel having greater channel resistance. Also, of the shock waves generated in the liquid chamber at the time of discharging liquid, the shock waves passing through the individual channels need to pass through the second common channel.

Moreover, in the event that shock waves head toward other liquid discharge portions, these must pass through the second common channel to enter into individual channels.

Thus, a second common channel with great channel resistance exists between the first common channel and the individual channels, so sudden movement of liquid is incapacitated since it is accompanied by great resistance. Also, shock waves generated in the liquid chamber of one liquid discharge portion arrive at the liquid chambers of other liquid discharge portions after having been damped by the second common channel.

According to the present invention, supply of liquid to the liquid chambers can be performed in a stable manner, and also interference between liquid discharge portions due to discharging of liquid droplets can be reduced. Accordingly, the droplet amount discharged can be made constant, thereby reducing fluctuation in density of the droplets which have landed.

BRIEF DESCRIPTION OF THE DRAWINGS

FIG. 8 is a chart showing the No. of prototypes, and the dimensions thereof.

BEST MODE FOR CARRYING OUT THE INVENTION

Figure 1:
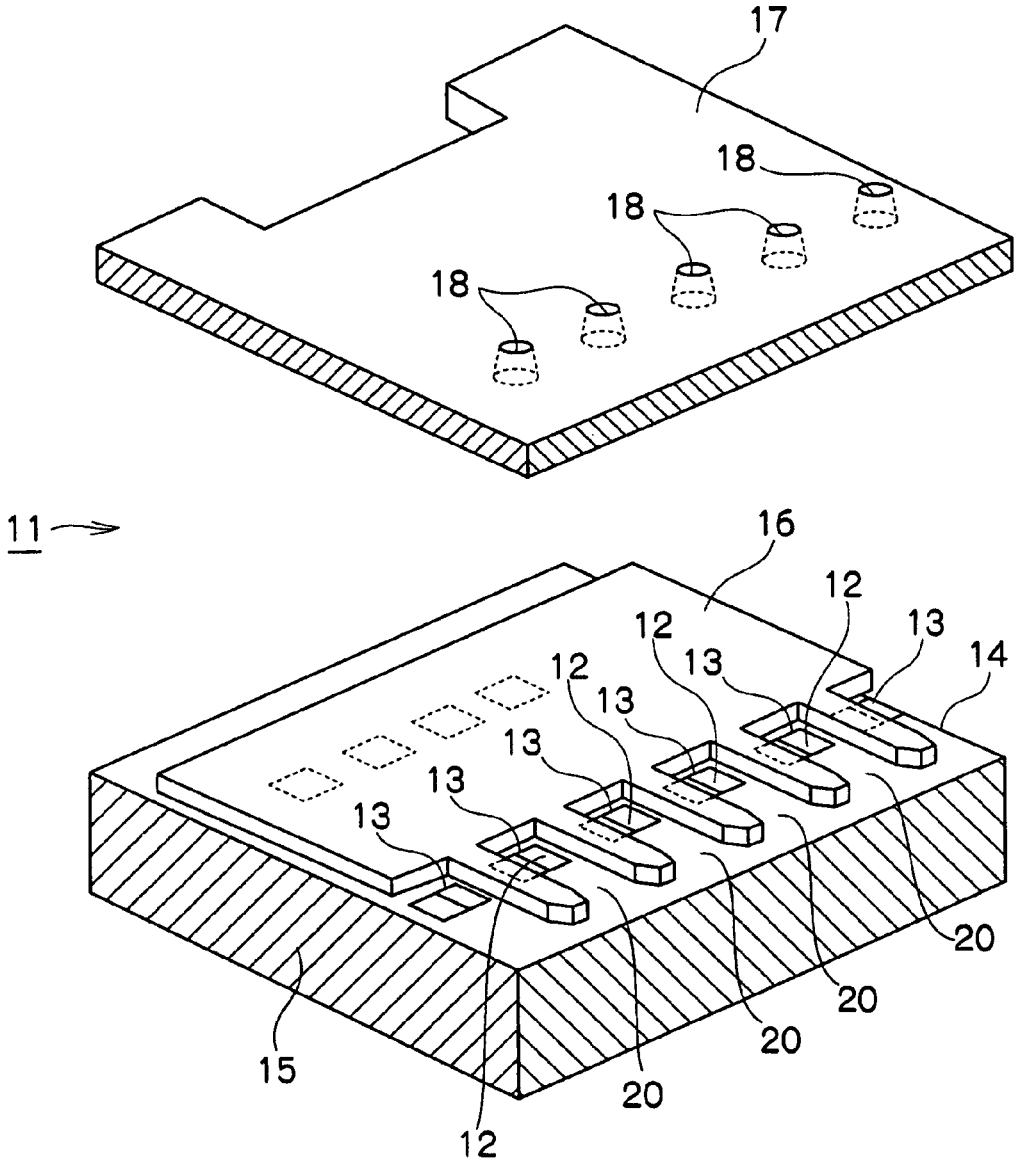
FIG. 1 is a disassembled perspective view illustrating an ink jet printer head to which the liquid discharge device according to the present invention has been applied.

The following is a description of one embodiment of the present invention, with reference to the drawings and so forth. FIG. 1 is a disassembled perspective view illustrating a head 11 of an ink jet printer (hereafter referred to simply as "printer") to which the liquid discharge device according to the present invention has been applied. A nozzle sheet (equivalent to a nozzle formation member in the present invention) 17 is glued onto a barrier layer 16, and FIG. 1 illustrates the nozzle sheet 17 disassembled therefrom.

Note that a later-described common channel 30 is omitted from FIG. 1, and only individual channels 20 are shown.

In the head 11, a substrate member 14 has a semiconductor substrate 15 formed of silicon or the like, and heating elements (a heat-emitting resistor formed of resistance in the present embodiment in particular, equivalent to flying force supplying means in the present invention) 13 formed by deposition on one face of the semiconductor substrate 15. The heating elements 13 are electrically connected with a later-described circuit, via conducting portions (not shown) formed on the semiconductor substrate 15.

Also, the barrier layer 16 is formed of light-hardening dry film resist for example, and is formed by deposition on the entire face of the semiconductor substrate 15 where the heating elements 13 have been formed, following which unnecessary portions are removed by a photolithography process.

Also, the nozzle sheet 17 has nozzles 18 formed by, for example, electroforming with nickel. The nozzle sheet 17 is adhered onto the barrier layer 16 such that the positions of the nozzles 18 match the positions of the heating elements 13, i.e., so that the nozzles 18 face the heating elements 13.

Ink liquid chambers 12 are formed of the substrate member 14, the barrier layer 16, and the nozzle sheet 17 so as to surround the heating elements 13. That is to say, in the drawing, the substrate member 14 makes up the base wall of the ink liquid chambers 12, the barrier layer 16 makes up the side walls of the ink liquid chambers 12, and the nozzle sheet 17 makes up the base wall of the ink liquid chambers 12.

A single head 11 described above normally has multiple heading elements 13 in increments of 100, and ink liquid chambers 12 having the heating elements 13, and uniquely selecting each of the heating elements 13 by commands from a printer control unit allows ink within the ink liquid chamber 12 corresponding to the heating element 13 to be discharged from the nozzles 18 facing the ink liquid chamber 12.

That is to say, the ink liquid chambers 12 are filled with ink from an ink tank (not shown) connected to the head 11, via the common channel 30 and further the individual channels 20. Pulsed electric current is applied to the heating elements 13 for short periods, e.g., 1 to 3 μsec, whereby the heating elements 13 are rapidly heated, and as a result a gaseous phase ink bubble is generated at the portion in contact with the heating element 13, such that ink of a certain volume is pushed away by the expansion of the ink bubble (the ink boils). Accordingly, ink of approximately the same volume as the ink pushed away at a portion in contact with the nozzle 18 is discharged from the nozzle 18 as a liquid droplet, and lands on printing paper (object of liquid discharging).

Note that in the present Specification, a portion configured of one ink liquid chamber 12, the heating element 13 disposed within this one ink liquid chamber 12, and the nozzle sheet 17 including the nozzle 18 disposed thereabove, will be called a "liquid discharge portion". That is to say, the head 11 is an array of multiple liquid discharge portions.

Also, in FIG. 1, the barrier layer 16 has a generally tooth-comb-like structure in a planer view. Accordingly, ink channels extending forward to the right side are formed communicating with the ink liquid chambers 12. These portions are the individual channels 20 provided for each liquid discharge portion. The individual channels 20 communicate with the later-described common channel 30, such that ink is sent form the common channel 30 to the individual channels 20, and further, ink is sent from the individual channels 20 to the ink liquid chambers 12.

Figure 2:
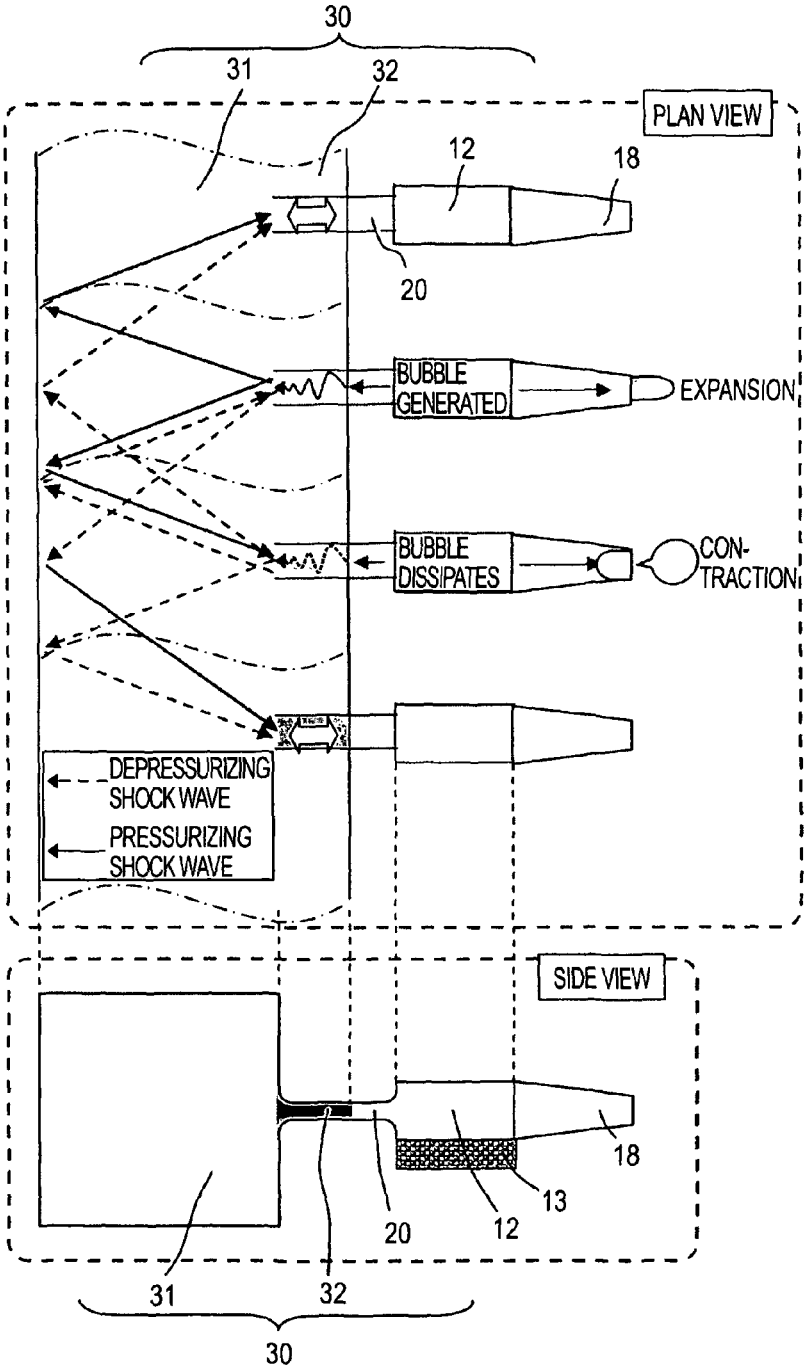
FIG. 2 is a plan view and side view schematically illustrating the communication state of an ink liquid chamber, individual channel, and common channel.

FIG. 2 is a plan view and side view schematically illustrating the communication state of the ink liquid chambers 12, individual channels 20, and common channel 30.

As described above, individual channels 20 are provided for each of the ink liquid chambers 12, with the single common channel 30 being provided as a channel communicating with all individual channels 20. Further, with the present invention, the common channel 30 is configured of a first common channel 31 and a second common channel 32. The first common channel 31 is provided on the side of an ink tank (not shown), i.e., on the ink supply side, and is communicable with the ink tank, and has a large channel area as with conventional arrangements, for uniform supply of ink.

Also, the second common channel 32 is situated between the first common channel 31 and the individual channels 20, communicating with both. The second common channel 32 is for damping of interference and disturbance, and is provided independently from the first common channel 31. Note that the second common channel 32 is literally part of the common channel 30, and accordingly communicates with all individual channels 20.

Further, with the present invention, the second common channel 32 is adjacent to the individual channels 20, and is formed such that the channel resistance (the force working against the flow of liquid when liquid flows) is greater than that of the first common channel 31. On the other hand, the first common channel 31 is designed with a cross-sectional channel area far greater than that of the second common channel 32. Due to this difference in cross-sectional channel area, the channel resistance of the second common channel 32 is made greater than that of the first common channel 31.

Also, the plan view in FIG. 2 illustrates the states of expansion (bubble being generated) and contraction (bubble contraction) within the ink liquid chamber 12 of the liquid discharge portion.

First, at the time of the bubble being generated (expansion), pressurizing shock waves are generated, a pressurizing shock wave heading toward the discharge face side of the nozzle 18 and a pressurizing shock wave heading toward the common channel 30 side from the individual channel 20 side from the ink chamber 12.

While the pressurizing shock wave heads from the individual channel 20 toward the second common channel 32, the channel resistance of the second common channel 32 is great, so the pressurizing shock wave is considerably damped by the time of reaching the first common channel 31 side, due to having passed through this second common channel 32. Accordingly, the pressurizing shock wave is decidedly smaller than its original magnitude by the time of entering the first common channel 31. This pressurizing shock wave affects the adjacent liquid discharge portion, but needs to pass through the second channel 32 again (and the individual channel 20 of that liquid discharge portion) to reach the inside of the ink liquid chamber 12 of the adjacent liquid discharge portion. Accordingly, the pressurizing shock wave is damped by passing through the second channel 32 again (and the individual channel 20 of the liquid discharge portion).

Thus, the pressurizing shock wave generated by generating the bubble passes through the second common channel 32 having a great channel resistance twice before reaching an ink liquid chamber 12 of another liquid discharge portion, so the pressurizing shock wave is damped through these passages to a level wherein effects on the ink liquid chamber 12 is practically negligible at the time of reaching an ink liquid chamber 12 of another liquid discharge portion.

Also, a depressurizing shock wave is generated by the bubble dissipating (contraction) as well but in the same way as with the above case of pressurizing shock wave, must pass through the second common channel 32 a great channel resistance twice before reaching the ink liquid chamber 12 of another liquid discharge portion, so the pressurizing shock wave is considerably damped, and is damped to a level wherein effects on the ink liquid chamber 12 is practically negligible at the time of reaching an ink liquid chamber 12 of another liquid discharge portion.

That is to say, the channel resistance of the second common channel 32 is great, so sudden movement of ink through the second common channel 32 is incapacitated due to the great resistance (channel resistance is inversely proportionate to the width thereof, and is inversely proportionate to the speed squared).

As described above, the second channel 32 functions as a so-called damping zone.

Also, in the event that fluctuation in pressure occurs at the first common channel 31 side due to reason other than discharge of the liquid, e.g., in cases wherein there is fluctuation in the amount of ink supplied externally to the first common channel 31 or in the event that the supply speed increases such that the internal ink flow becomes turbulent, this can be alleviated (effects on the ink liquid chamber 12 can be reduced).

Accordingly, the liquid discharge portions can discharge a constantly-stable ink droplet amount, and consequently, highly fine printing is enabled. Also, suitably selecting the channel resistance for the second common channel 32 allows interference occurring under pressure fluctuation at the time of the individual liquid discharge portions discharging ink droplets to be markedly reduced.

Further, the common channel 30 as with the present invention can also be applied to a head (unit) formed by arraying multiple heads 11, besides the serial method formed of a single head 11.

Figure 3:
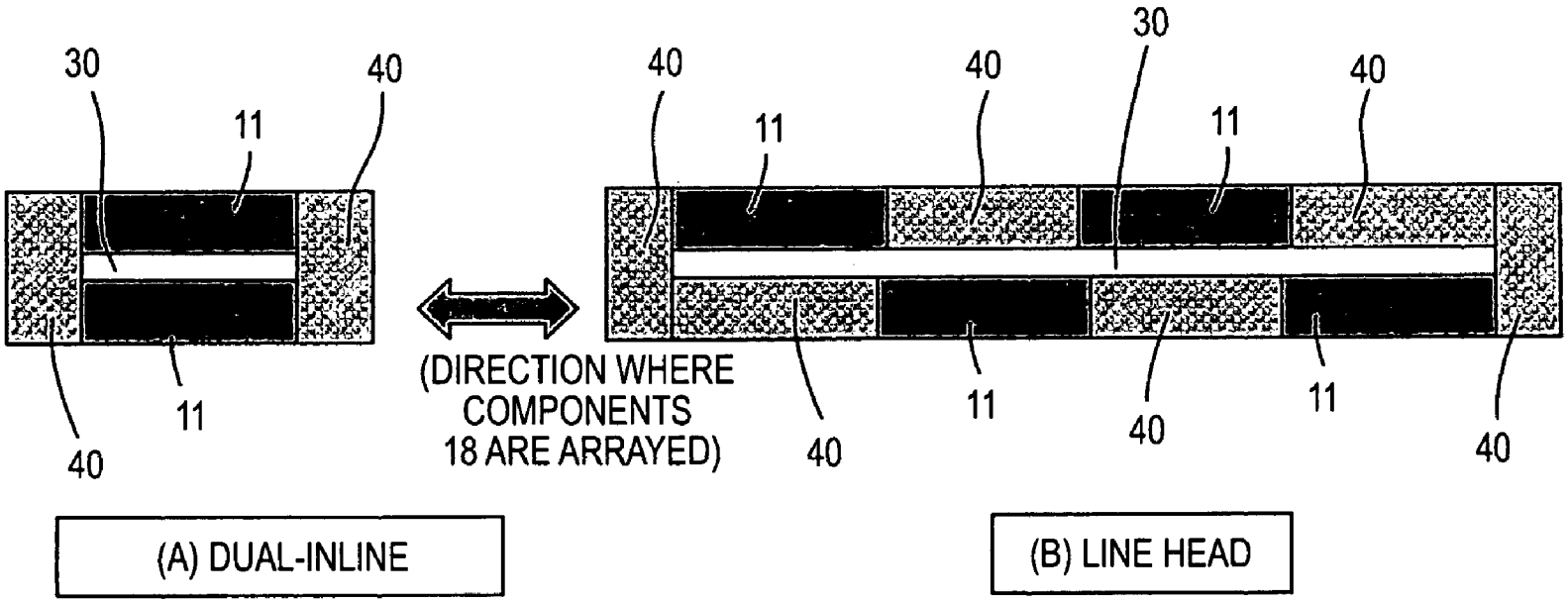
FIG. 3 is a plan view illustrating a dual inline type head (A in the drawing) and a line head (B in the drawing).

FIG. 3 is a plan view illustrating a dual inline type (A in the drawing) head (dual inline head) and a line (B in the drawing) head (line head).

The dial inline type head shown in FIG. 3, unlike the structure wherein an ink supply hole formed of a through hole which reaches the front face of a head 11 from the rear face thereof is provided to a single head 11, is configured such that two heads 11 are arrayed perpendicularly as to the direction of array of nozzles 18 with both end portions closed off with dummy heads 40 (heads which are formed with at least the same size (external shape) as the heads 11 but which do not discharge ink droplets; and may be articles which do not have functions of a head, or may be heads 11 themselves), thereby forming a closed off common channel 30. Note that the individual channels 20 of the two heads 11 are disposed so as to face the common channel 30.

On the other hand, the line head which is an example shown in FIG. 3 has a layered structure wherein two array structures, each of which comprises four heads of the heads 11 and the dummy heads 40 alternately arrayed, are layered. With such an arrangement, both ends thereof are closed off with the dummy heads 40, thereby forming a closed off common channel 30. Note that the individual channels 20 of each heads 11 are disposed so as to face the common channel 30.

Next, the form of the second common channel 32 will be described in more detail. First, the channel resistance of the second common channel 32 is preferably formed such that the channel resistance as to the movement direction of ink toward all individual channels 20 is generally constant. For example, an example would be to make the channel cross-sectional area of the second common channel 32 in the direction of ink movement toward the individual channels 20 to be generally the same.

Also, in the event of using multiple heads 11, the second common channels 32 of all heads 11 are preferably formed so as to have the same channel resistance. Note that as shown in FIG. 3, in the event that one second common channel 32 is provided for all the heads 11, an example would be to make the channel cross-sectional area of the second common channel 32 in the direction of ink movement toward the individual channels 20 to be generally the same. Moreover, though not shown in the drawings, in the event of using multiple heads 11, and providing multiple second common channels 32, an example would be to make the channel cross-sectional area of the second common channels 32 in the direction of ink movement toward the individual channels 20 communicating with the second common channels 32 to be constant.

Moreover yet, the direction of movement of ink in the second common channel 32 (channel direction) may be the same direction as that of the individual channels 20 (meaning that the direction is the same when viewed in the side view in FIG. 2), but may be another direction. For example, an arrangement wherein the second common channel 32 is provided on the substrate member 14 upon which are provided the individual channels 20 so as to communicate with the individual channels 20 enables the direction of movement of ink of the second common channel 32 and the individual channels 20 to be the same. Also note that even in a case wherein the second common channel 32 is not formed within the same face the individual channels 20, the direction of movement of ink between the second common channel 32 and the individual channels 20 can be set in parallel directions. An example would be to provide on a face above the face where the individual channels 20 are provided, parallel with the face where the individual channels 20 are provided.

Particularly, providing the second common channel 32 on the same face with the individual channels 20 enables a second common channel 32 having uniform damping properties to be formed at low costs. In the following description, the second common channel 32 disposed such that the direction of movement of ink is parallel with that of the individual channels 20 as described above will be called a "horizontal common channel 32*c*".

Further, the direction of movement of ink of the individual channels 20 and the direction of movement of ink of the second common channel 32 may be set perpendicularly. For example, the second common channel 32 can be formed using a face adjacent to the face where the individual channels 20 are formed, and perpendicularly to the face where the individual channels 20 are formed (e.g., the side face indicated by hatching to the front right side of the substrate member 14 in FIG. 1). In this case, the second channel 32 can be formed in the assembly process following formation of the heads 11, meaning that the channel properties can be freely determined according to the nature of the ink and so forth.

In the following description, the second common channel 32 disposed such that the direction of movement of ink is perpendicular to that of the individual channels 20 as described above will be called a "perpendicular common channel 32*d*".

Also, in the event of forming the second common channel 32 using dummy heads 40 or other heads 11, the second common channel 32 can be easily formed. Particularly, in the event of forming the second common channel 32 with other heads 11, the second common channel 32 can be formed which can be shared with multiple heads 11 and with the same properties.

Moreover, the second common channel 32 can be formed from a communicating arrangement of a horizontal common channel 32*c* and perpendicular common channel 32*d*. That is to say, a horizontal common channel 32*c* provided such that the direction of movement of ink is parallel with that of the individual channels 20, and a perpendicular common channel 32*d* provided such that the direction of movement of ink is perpendicular to that of the individual channels 20, can be provided at the same time. Accordingly, synergistic results of the properties of the horizontal common channel 32*c* and the perpendicular common channel 32*d* can be obtained. Also, great damping of disturbance can be effected.

Also, in the event of forming the horizontal common channel 32*c* in the same face as with the individual channels 20, this is performed at the very end of the pre-processing stage of the semiconductor. On the other hand, in the event that the perpendicular common channel 32*d* is formed using a face perpendicular to the face where the individual channels 20 are formed, this is performed in the post processing. Accordingly, changing of the properties of the second common channel 32 as necessary can be performed relatively easily, which is advantageous in that the second common channel 32 can be formed to mach properties of different liquids (inks), or even in the event of using the same head 11, the second common channel 32 can be formed according to the purpose thereof.

Note that the second common channel 32 may be formed on the substrate member 14, or on a same structure which is integral with the head 11 though not on the substrate 14, or on a structure which is different form the head 11.

Also, while separate and independent members from the liquid discharge portions and individual channels 20 may be used for members forming the second common channel 32, but in the event that a part of the members of the liquid discharge portions and individual channels 20 can be used, using these members is preferable.

Figure 4:
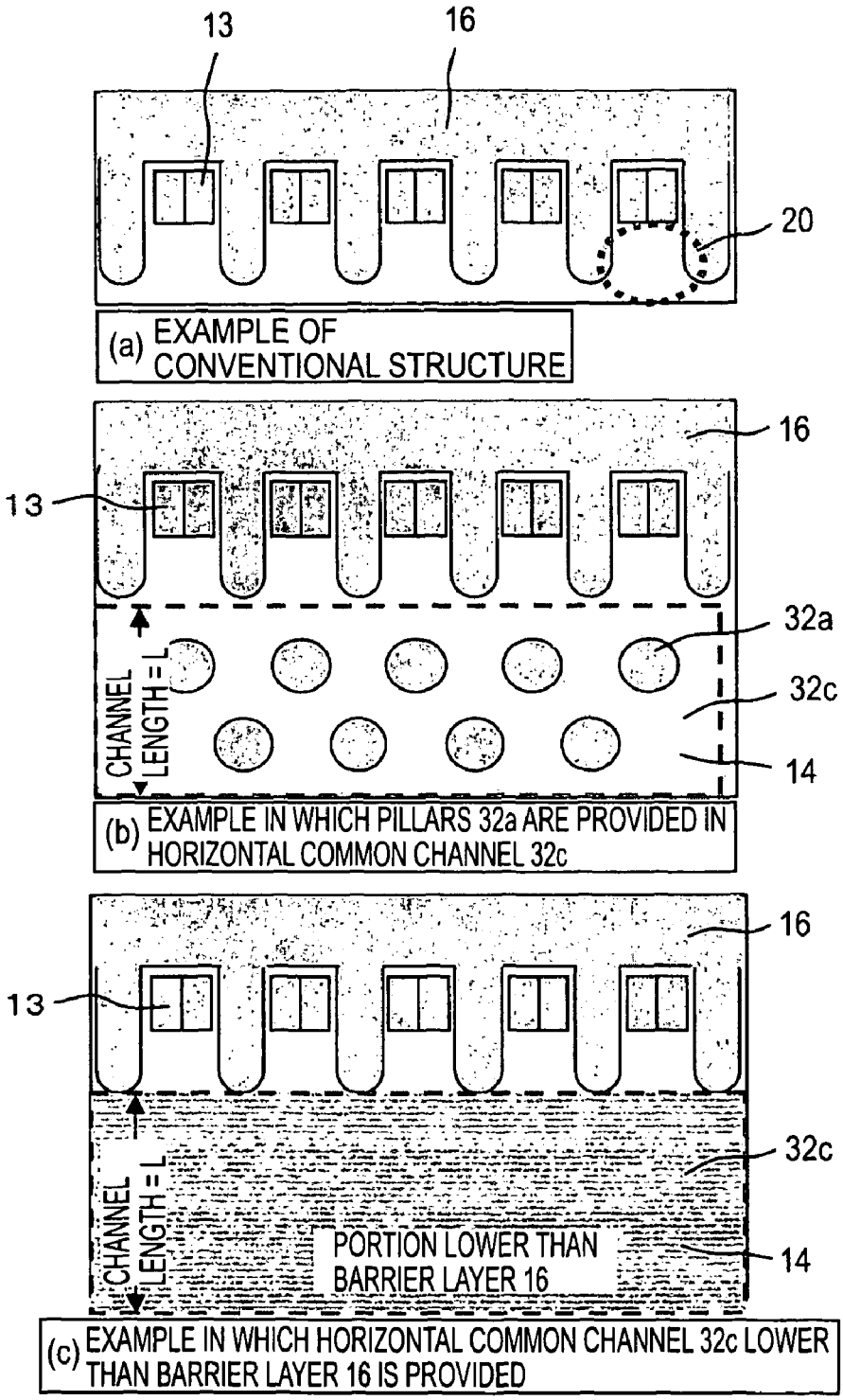
FIG. 4 is a plan view illustrating two exemplary forms of a horizontal common channel.

FIG. 4 is a plan view illustrating two exemplary forms of the horizontal common channel 32*c*. In FIG. 4, the drawing (a) at the top illustrates a conventional positional relation between the heating elements 13 and barrier layer 16, and individual channels 20. As can be clearly understood from this drawing, the side walls of the individual channels 20 are formed of the barrier layer 16.

In the event of providing a horizontal common channel 32*c* in a head 11 with such a form, an arrangement is conceivable wherein, first, the substrate member 14 is extended toward the individual channel 20 side as indicated in the center drawing (b) in FIG. 4, so as to form a horizontal common channel 32*c* (channel length=L), with multiple generally cylindrical pillars 32*a* being provided on that plane. Note that the thickness (height) of the horizontal common channel 32*c* in this case is the same as the thickness of the barrier layer 16. Also, the pillars 32*a* are formed of the same material as with the barrier layer 16, at the time of formation of the barrier layer 16. The barrier layer 16 is formed at one time by photolithography, so forming the pillars 32*a* along with the barrier layer 16 using this technique enables a horizontal common channel 32*c* with pillars 32*c* having stable channel resistance values to be formed. Also, costs can be reduced.

Also, the method of forming multiple pillars 32*a* allows the area of the substrate member 14 serving as the base wall of the horizontal common channel 32*c* to be reduced, so the yield from one semiconductor wafer (how many substrate members 14 can be obtained from a single semiconductor waver) can be improved, which is advantageous cost-wise. Further, the channel resistance value in the direction of array of the liquid discharge portions (nozzles 18) can also be increased, so shock waves can be damped more efficiently.

Also, the lower drawing (c) in FIG. 4 illustrates an example wherein the substrate member 14 is extended downward toward the individual channel 20 side without using pillars, so that the horizontal common channel 32*c* is formed on the same face as with the individual channels 20 (channel length=L). In this case, the height of the ceiling of the horizontal common channel 32*c* is set lower than the barrier layer 16. That is to say, the horizontal common channel 32*c* is lower than the individual channels 20 in the height direction. Forming the horizontal common channel 32*c* in this way improves the channel resistance thereof. Note that an example of the height of the horizontal common channel 32*c* in this case is around ½ the thickness of the barrier layer 16.

Figure 5:
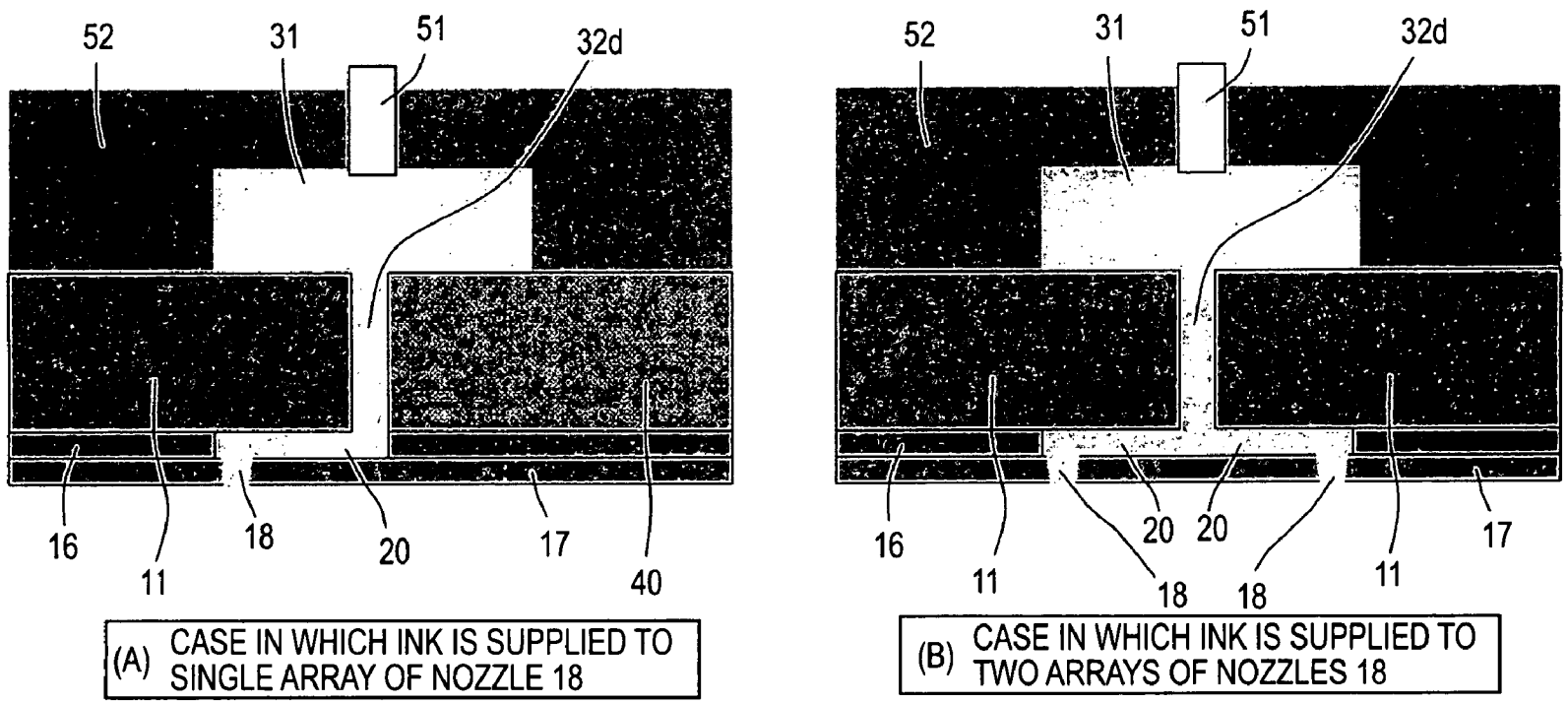
FIG. 5 is a cross-sectional view illustrating a vertical common channel, the left side illustrating an example of a case wherein ink is supplied to one row of nozzles, and the right side illustrating an example of a case wherein ink is supplied to two rows of nozzles.
Figure 6:
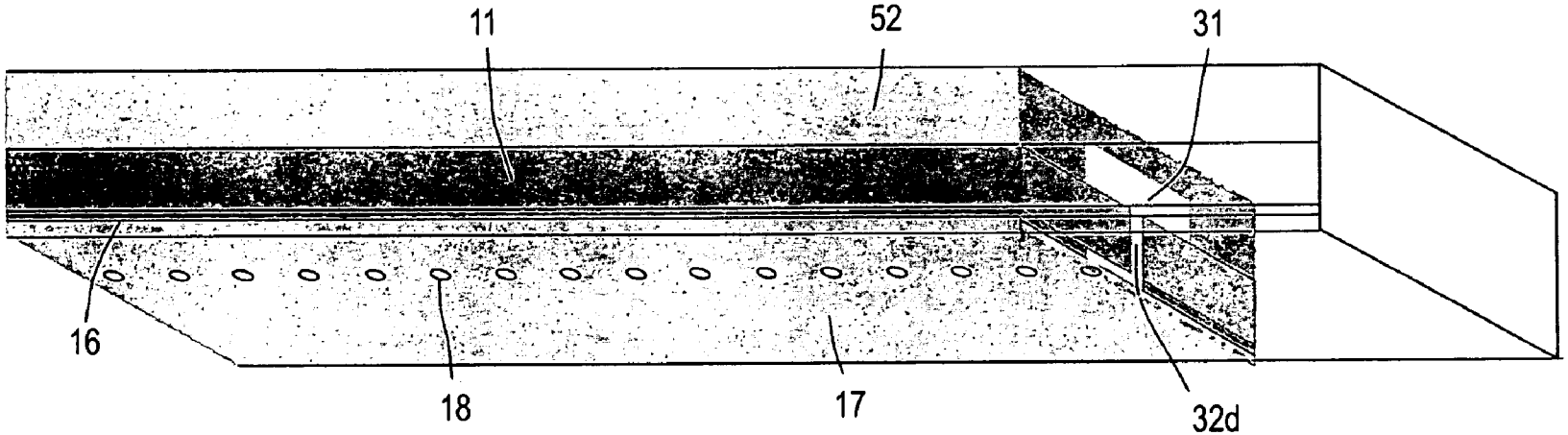
FIG. 6 is a perspective view of the article shown at the left in FIG. 5 from a lower oblique direction.

Also, FIG. 5 is a cross-sectional view illustrating two examples of providing the perpendicular common channel 32*d*, the left side drawing (A) illustrating an example of a case wherein ink is supplied to a single array of nozzles 18, and the right side drawing (B) illustrating an example of a case wherein ink is supplied to two arrays of nozzles 18. Moreover, FIG. 6 is a perspective view of the article shown at the left side drawing (A) in FIG. 5 from a lower oblique direction.

As described above, in the event of forming the perpendicular common channel 32*d* using a face adjacent to the face where the individual channels 20 are formed, the width of the perpendicular common channel 32*d* (the distance between the head 11 and dummy tip 40 or between the heads 11) can be selected in the assembly processes relatively freely, and the channel resistance of the perpendicular common channel 32*d* can be adjusted according to the object even following formation of the head 11.

In FIG. 5, a channel frame 52 is provided on the face of the head 11 opposite to the nozzle sheet 17, with the first common channel 31 being formed within. Also, a liquid supply channel 51 which communicates with the inner first common channel 31 is provided to the channel frame 52. Also, the perpendicular common channel 32*d* is formed between the head 11 and dummy head 40 (the case of (A)), or between the heads 11 (case of (B)).

The perpendicular common channel 32*d* is disposed generally perpendicular to the discharge face of the nozzles 18, and is configured using the viscous resistance due to a part of the head 11 coming into contact with ink. Such a configuration provides an extremely great channel resistance in the array direction of the nozzles 18. Also, there is little interference in the sideways direction, and the ink moves in a direction perpendicular to the ink movement direction of the individual channels 20 as compared to the horizontal common channel 32*c*, so there is the advantage that the perpendicular common channel 32*d* can be shared with other heads 11 as shown in the right side drawing (B) in FIG. 5.

Also as shown in the right side drawing (B) in FIG. 5, in a case wherein ink is supplied to the individual channels 20 of different heads 11, there is the advantage that no irregularities in channel resistance or the like occurs between the heads 11. Further, even in a case wherein the perpendicular common channel 32*d* is shared with the two opposing heads 11, the discharge properties of all the liquid discharge portions of the two heads 11 can be made uniform by discharging ink droplets in an order such that interference essentially does not occur therebetween.

EMBODIMENT

Next, an embodiment of the present invention (including experimentation results) will be described.

The present embodiment has both the horizontal common channel 32*c* (disposed on the same face as the individual channels 20) and the perpendicular common channel 32*d*. A total of four prototypes, three types wherein the horizontal common channels 32*c* are the same and the perpendicular common channels 32*d* differ, and one wherein the perpendicular common channel 32*d* is the same and the horizontal common channel 32*c* is different (prototype Nos. "SS207", "SS941", "SS1062", and "SS1083"), were fabricated, and properties were compared.

Figure 7:
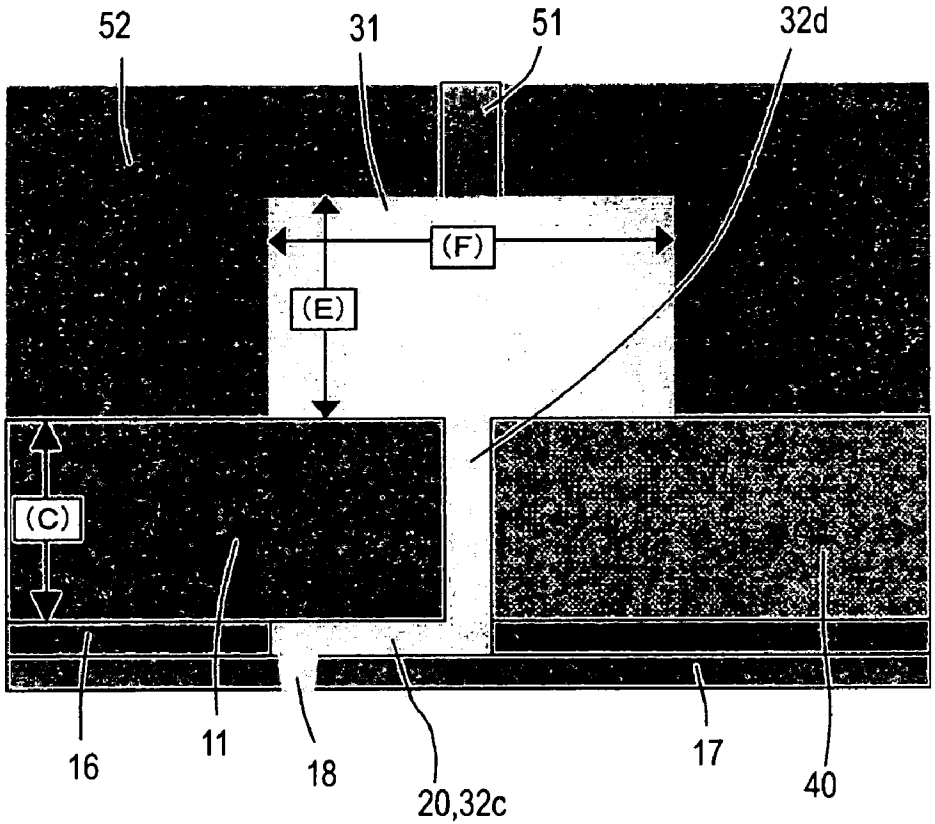
FIG. 7 is a cross-sectional view for describing the dimensions of a prototype.

FIG. 7 is a cross-sectional view for describing the dimensions of the prototypes, with the shape being the same as the left side drawing (A) in FIG. 5. Also, FIG. 8 is a chart showing the prototype Nos. and the dimensions thereof.

Figure 9:
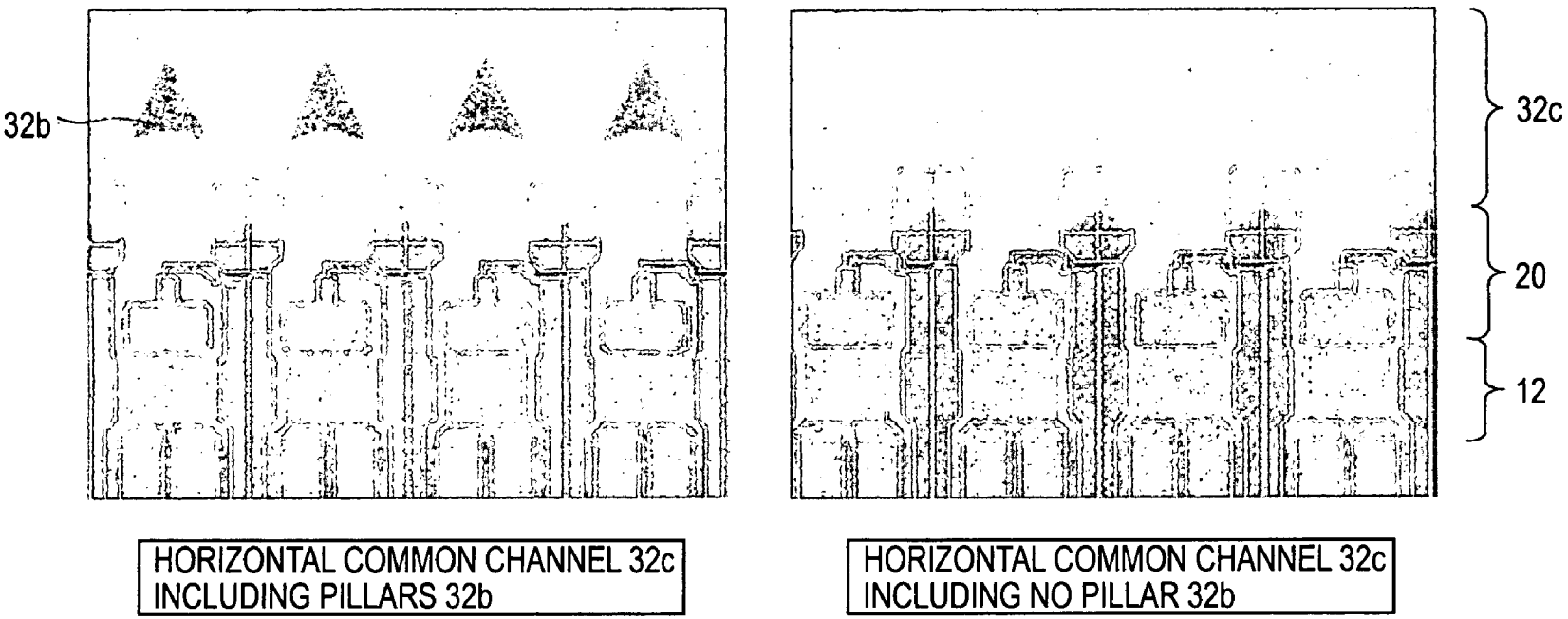
FIG. 9 is a plan view illustrating pillars provided in the horizontal common channels for prototype Nos. "SS207", "SS941", and "SS1062".

Further, FIG. 9 is a plan view illustrating pillars (triangular cross-sectional shapes) 32*b* provided in the perpendicular common channel 32*d* in prototype Nos. "SS207", "SS941", and "SS1062".

Note that in FIG. 8, while the prototype Nos. "SS941" and "SS1062" are of identical dimensions, there actually is partial difference. However, description of this point will be omitted in the present embodiment.

Now description will be made regarding what was used as an index, and how measurement was performed.

Generally, as means for measuring the amount of ink droplets discharged from liquid discharge portions in a relatively correct manner, a method of measuring the recording contents with an image reader (image scanner, etc.) and reading as change in density is easy and practical. However, with this method, the properties of the measurement system are not accurately known, so while qualitative items can be known, quantitative measurement is difficult, and there are cases wherein phenomena cannot be correctly measured depending on the properties of the system (an example is deterioration of frequency characteristic (F characteristic) of the image reading device itself).

Accordingly, at least F-characteristic correction should be performed for the measurement system such that the F-characteristic limit of the measurement system is higher than the cut-off limit (fco) of the (two-dimensional) spatial frequency observed upon ink droplets being arrayed. This facilitates observation (observation is still possible even in the event that the F-characteristic is narrower than fco, but fluctuations occurring in a range of high frequencies die out and are less readily recognizable).

Figure 10:
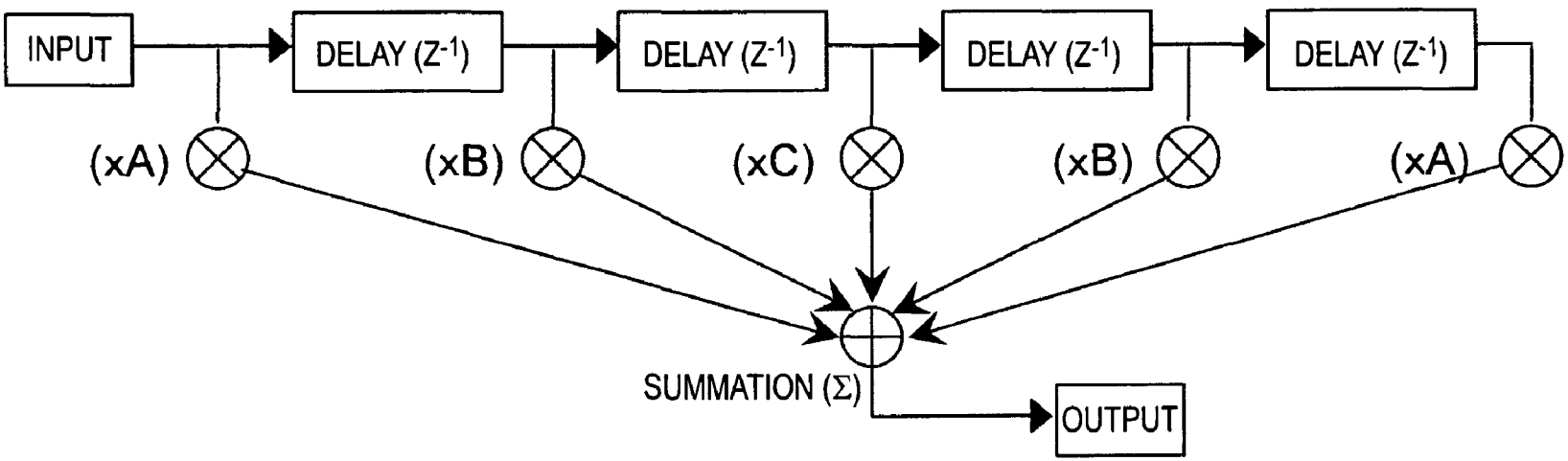
FIG. 10 is a diagram illustrating a so-called transversal filter.

FIG. 10 is a diagram illustrating a so-called transversal filter obtained by multiplying delayed data by different coefficients and adding the results, often used as means for F-characteristic correction. In order to determine the properties of the 5-point tap F-characteristic correction filter shown in FIG. 10, there generally is the need to determine the five coefficients (multipliers for multiplication), but according to digital filter theory, providing a condition in that phase properties are not changed allows symmetrical coefficients to suffice (also called a cosine equalizer, since only cosine functions are included), and determining the three constants of A, B, and C, as shown in FIG. 10, is sufficient.

The F-characteristic (=F(ω)) of a filter having such coefficients can be basically expressed by $$F(\omega)=C+2A\ \mathrm{Cos}(2\omega)+2B\ \mathrm{Cos}(\omega) \quad \text{(Expression 1)}$$

$$F(\omega)=0.5-2A+2A\ \mathrm{Cos}(2\omega)+\mathrm{Cos}(\omega) \quad \text{(Expression 2)}$$

wherein $\omega=2\pi/T$. T is the delay time per stage in FIG. 10. In the case of Expression 2, satisfying the conditions of $F(\omega)=1$ if $\omega=0$, and $F(\omega)=0$ if $\omega=\pi$ is required.

Figure 11:
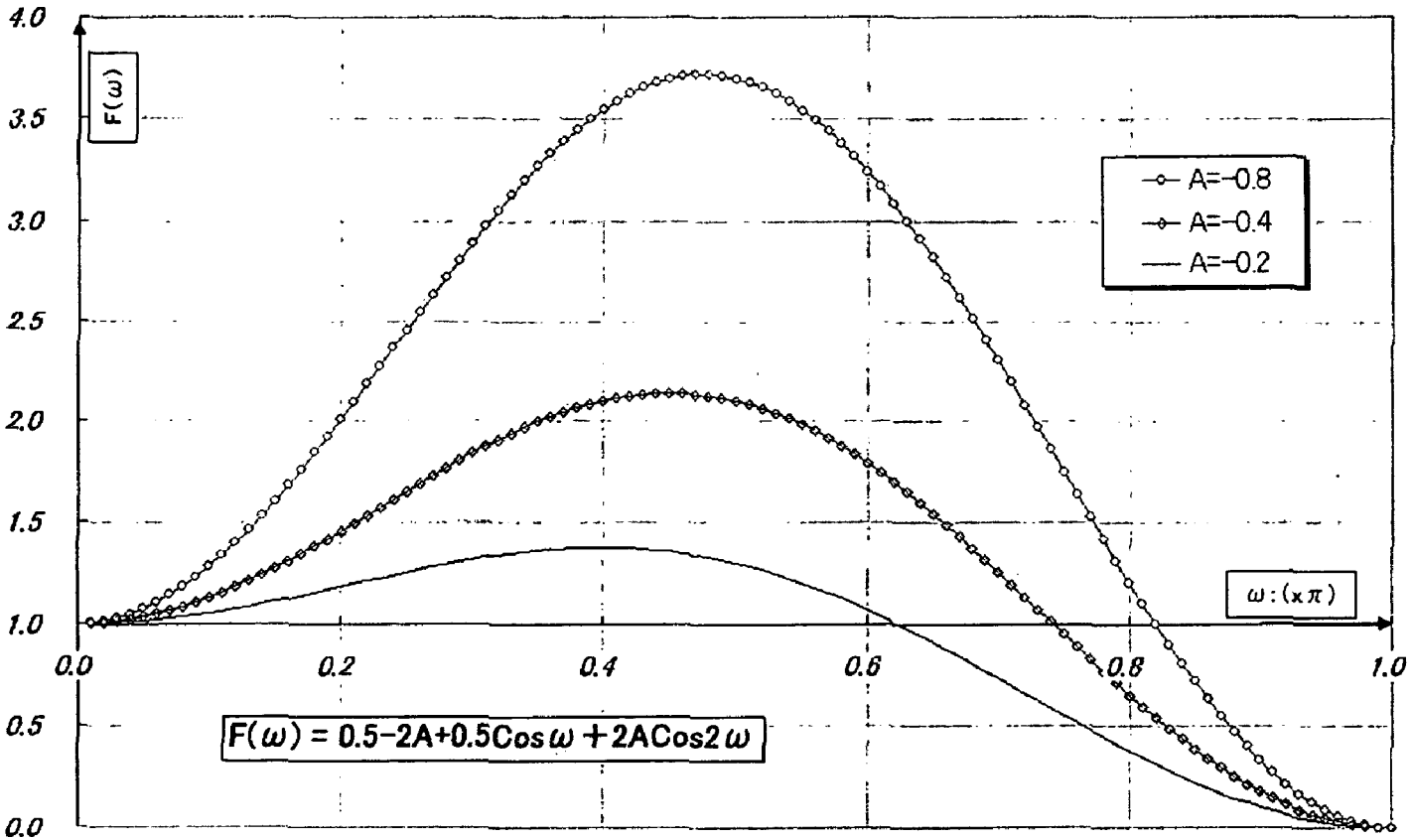
FIG. 11 is a graph illustrating the property of F(ω) in the event of changing the value of A in Expression 1 arbitrarily.

In the case of Expression 2, conditions for an even better filter, i.e., a condition wherein "decay at Nyquist frequency is maximized" and the condition wherein gain is set to 1 at low frequencies, are satisfied, and in this case, determining one coefficient (e.g., A) is sufficient. FIG. 11 is a drawing illustrating the property of F(ω) in the event of changing the value of A in Expression 1 arbitrarily.

Figure 12:
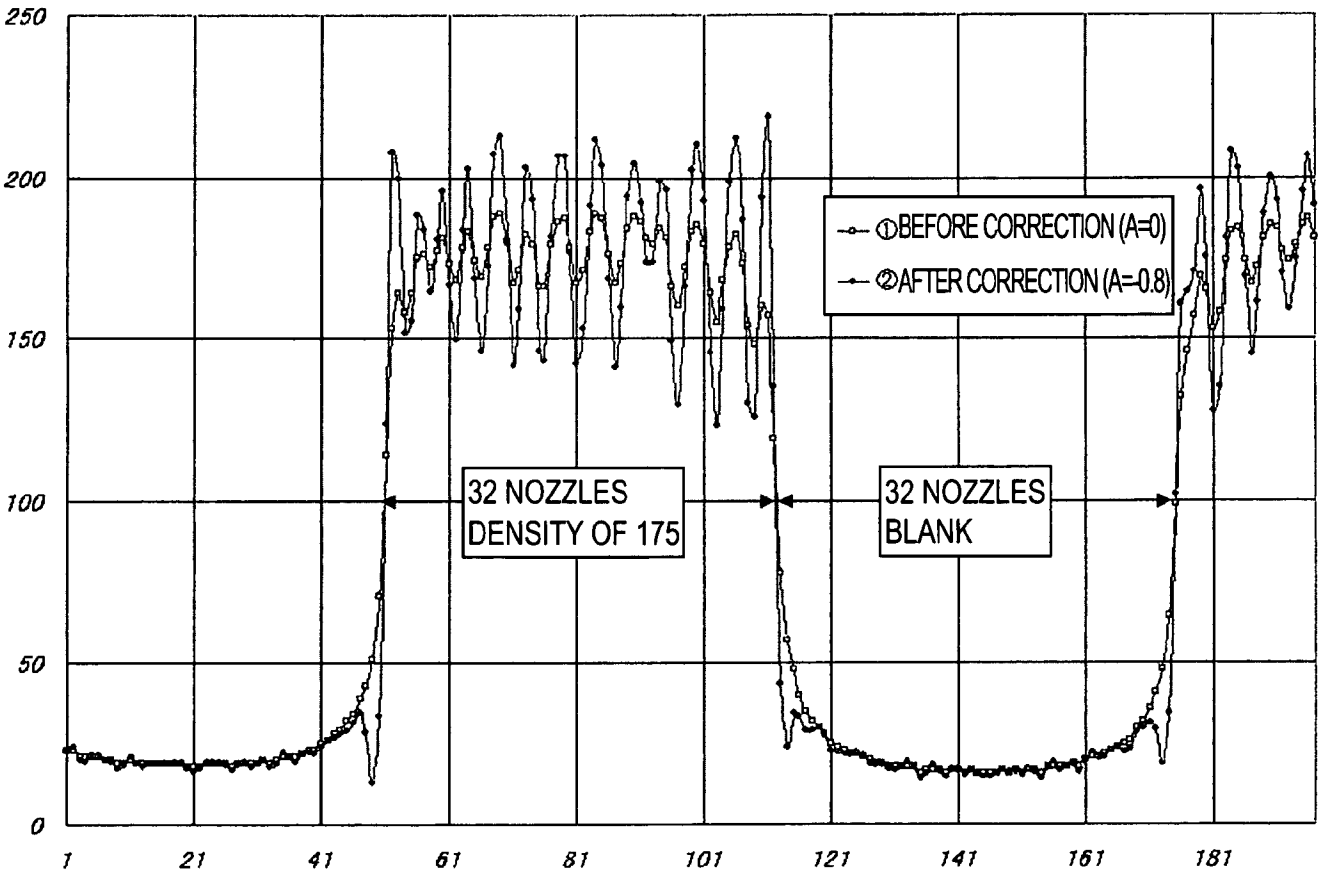
FIG. 12 illustrates a case wherein the coefficient A is suitably selected and a setting value, desirable with an image reading apparatus used for experimenting with the embodiment, has been obtained.
Figure 20:
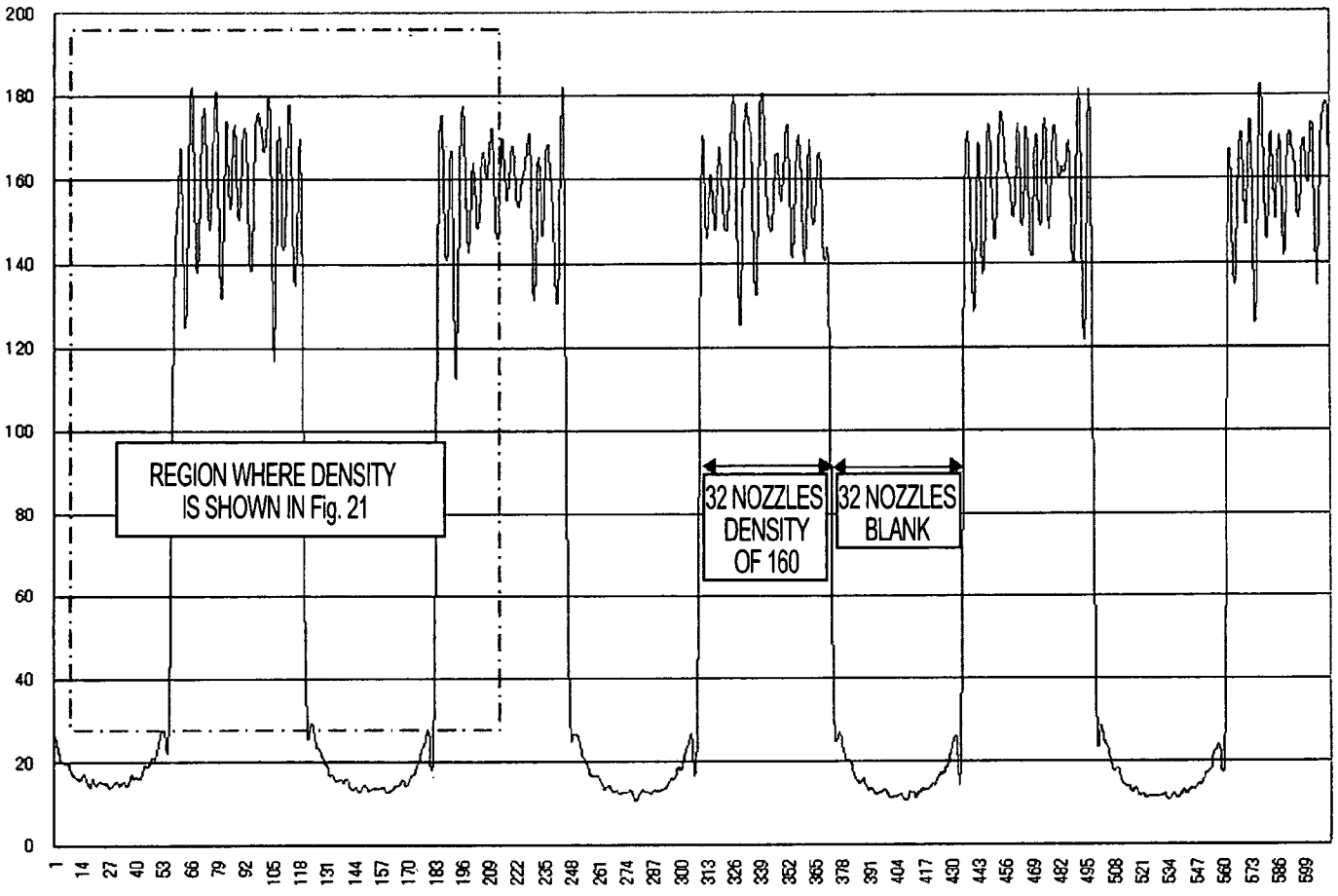
FIG. 20 is a graph representation of the results of performing ink droplet discharge with an ink jet printer line head manufactured for 600 dpi, and measuring change in density of the discharged ink as change in the ink droplets.

Also, FIG. 12 illustrates a case wherein the coefficient A is suitably selected and a setting value, desirable with the image reading apparatus used for experimenting with the embodiment, has been obtained. It can be seen from FIG. 12 from the fact that a dulled rectangular wave for A=0 is corrected with around A=−0.8 into a wave having properties relatively suitable for comparative measurement (which provides the approximately flat frequency characteristic over the frequency). Note that the data in FIG. 12 is basically the same as that shown in FIG. 20.

The following is a comparison of recording results of the embodiment shown in FIG. 8, using the correction coefficient wherein Expression 2 with A of −0.8.

Figure 13:
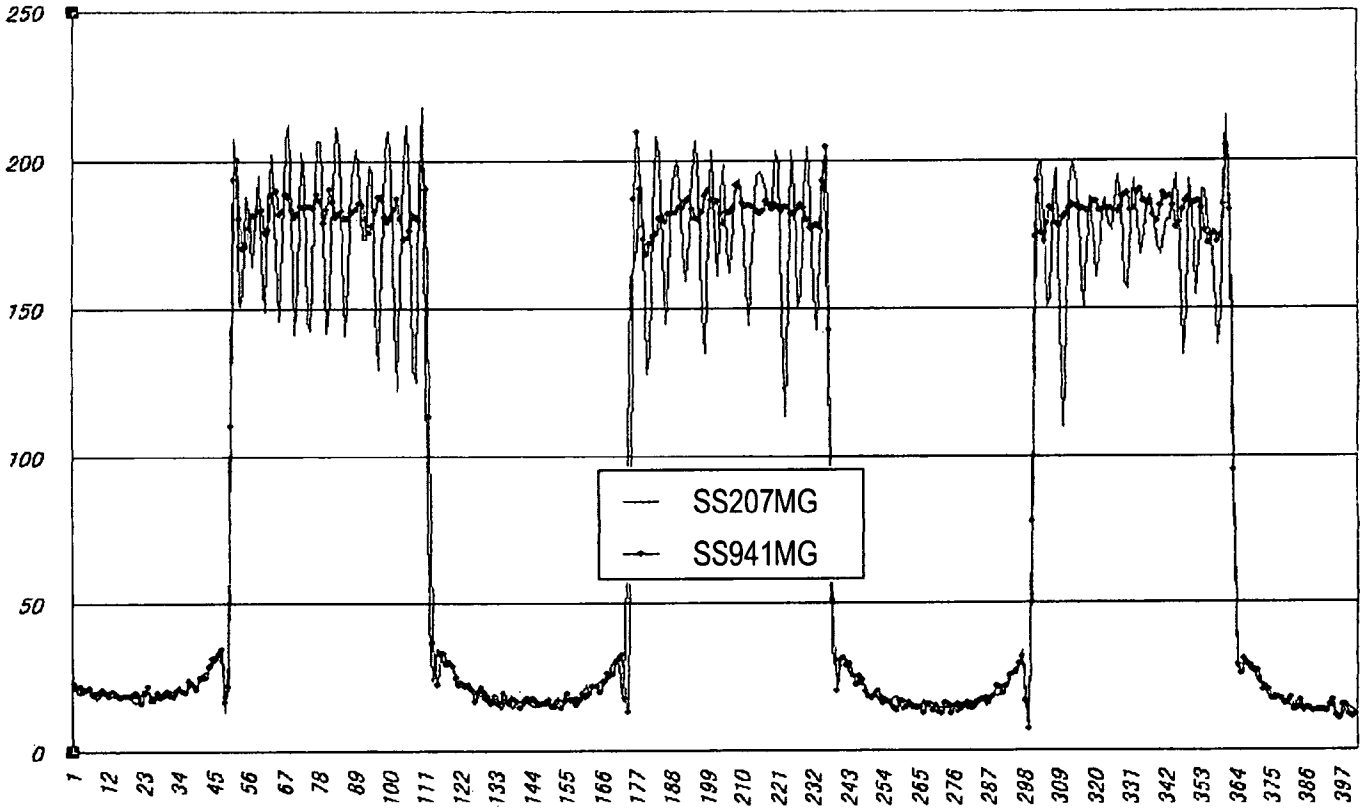
FIG. 13 is a graph illustrating a comparison of properties between prototype Nos. "SS207" and "SS941".

FIG. 13 is a graph illustrating a comparison of properties between prototype Nos. "SS207" and "SS941", i.e., the difference in fluctuation (difference in density at the time of recording) upon changing the channel width of the vertical common channel 32*d*. As can be clearly seen from FIG. 13, the effects of suppressing the fluctuation of the vertical common channel 32*d* are manifest.

Figure 14:
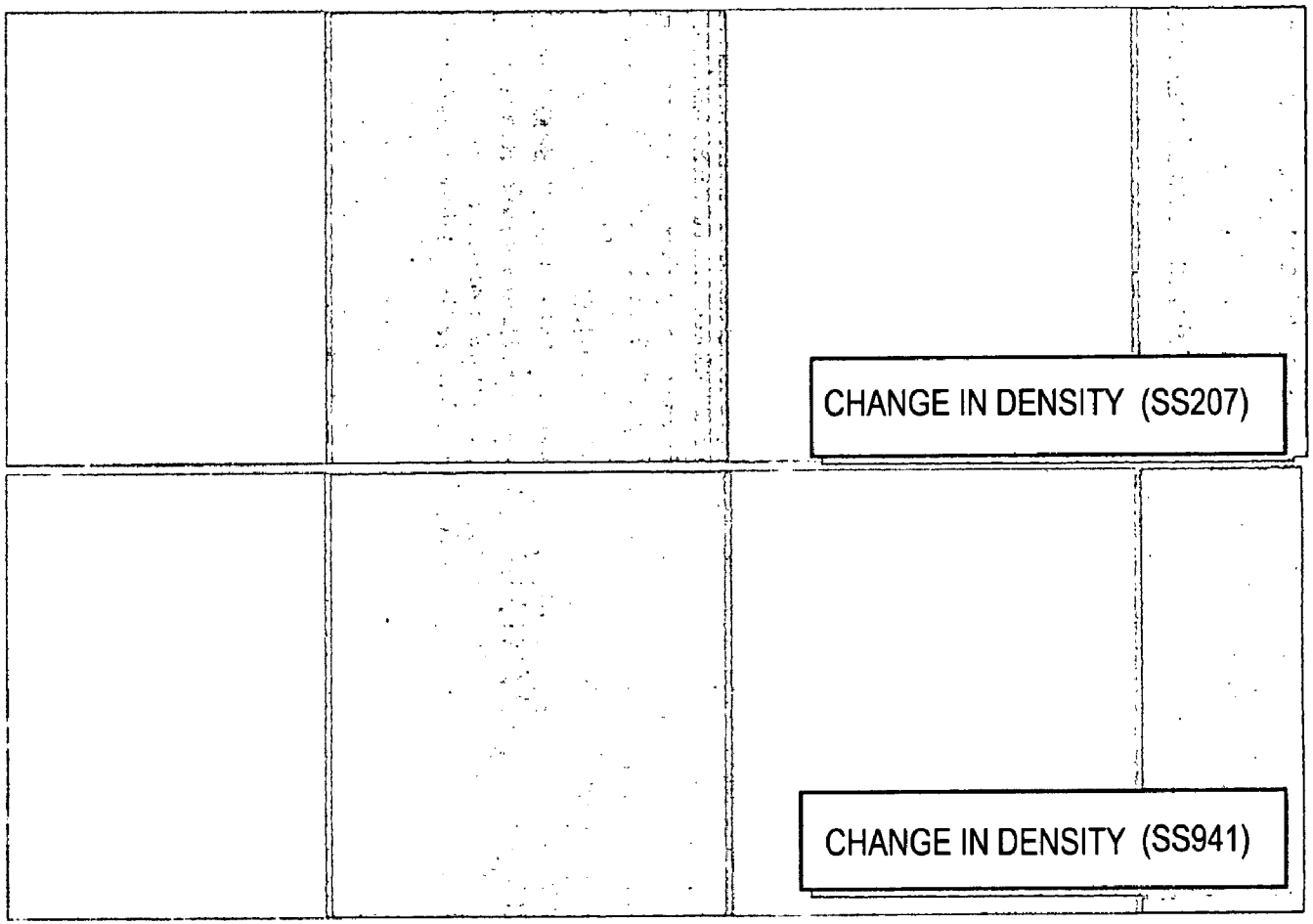
FIG. 14 is a diagram illustrating change in density between prototype Nos. "SS207" and "SS941" with lightness information alone.
Figure 21:
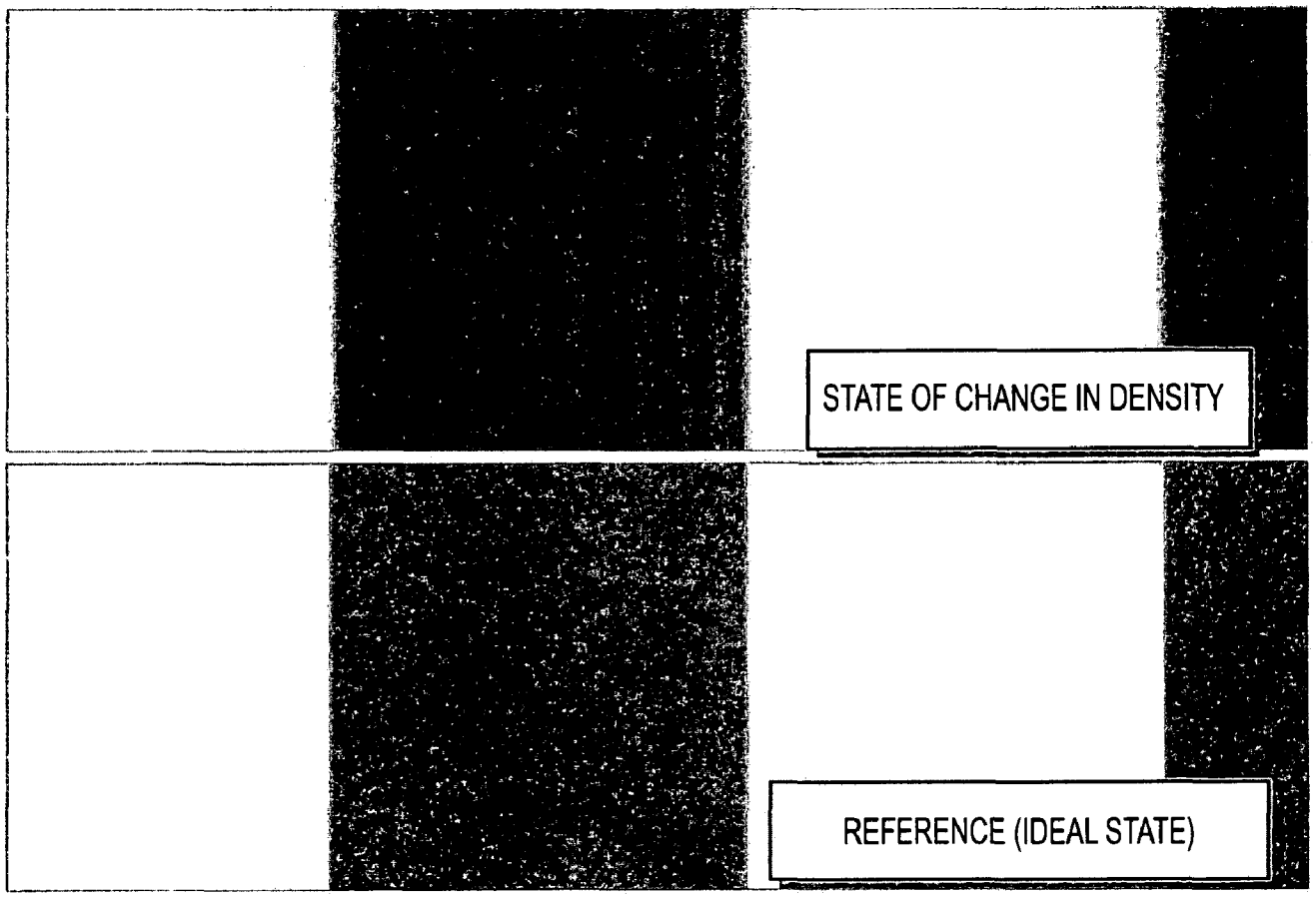
FIG. 21 illustrates, at the upper part, the portion in FIG. 20 surrounded by the single-dot broken line in the form of contrasting densities, and the lower part illustrates an ideal state wherein no change due to pressure fluctuation occurs, as an average density value (160).

Also, as with FIG. 21, FIG. 14 is a diagram illustrating change in density between prototype Nos. "SS207" and "SS941" with lightness information alone.

Figure 15:
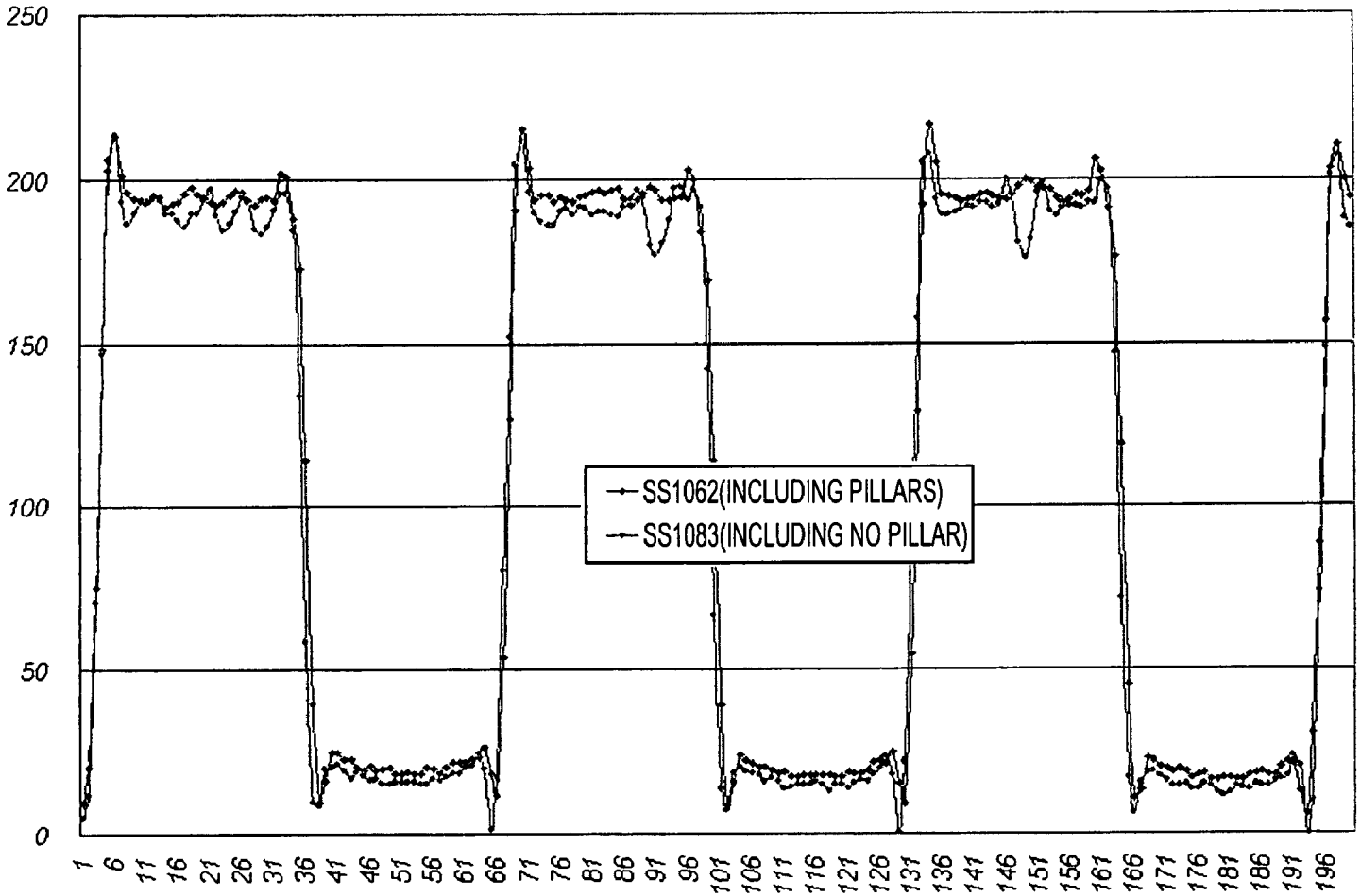
FIG. 15 is a graph illustrating the difference between prototype Nos. "SS1062" and "SS1083" according to difference in the horizontal common channel.
Figure 16:
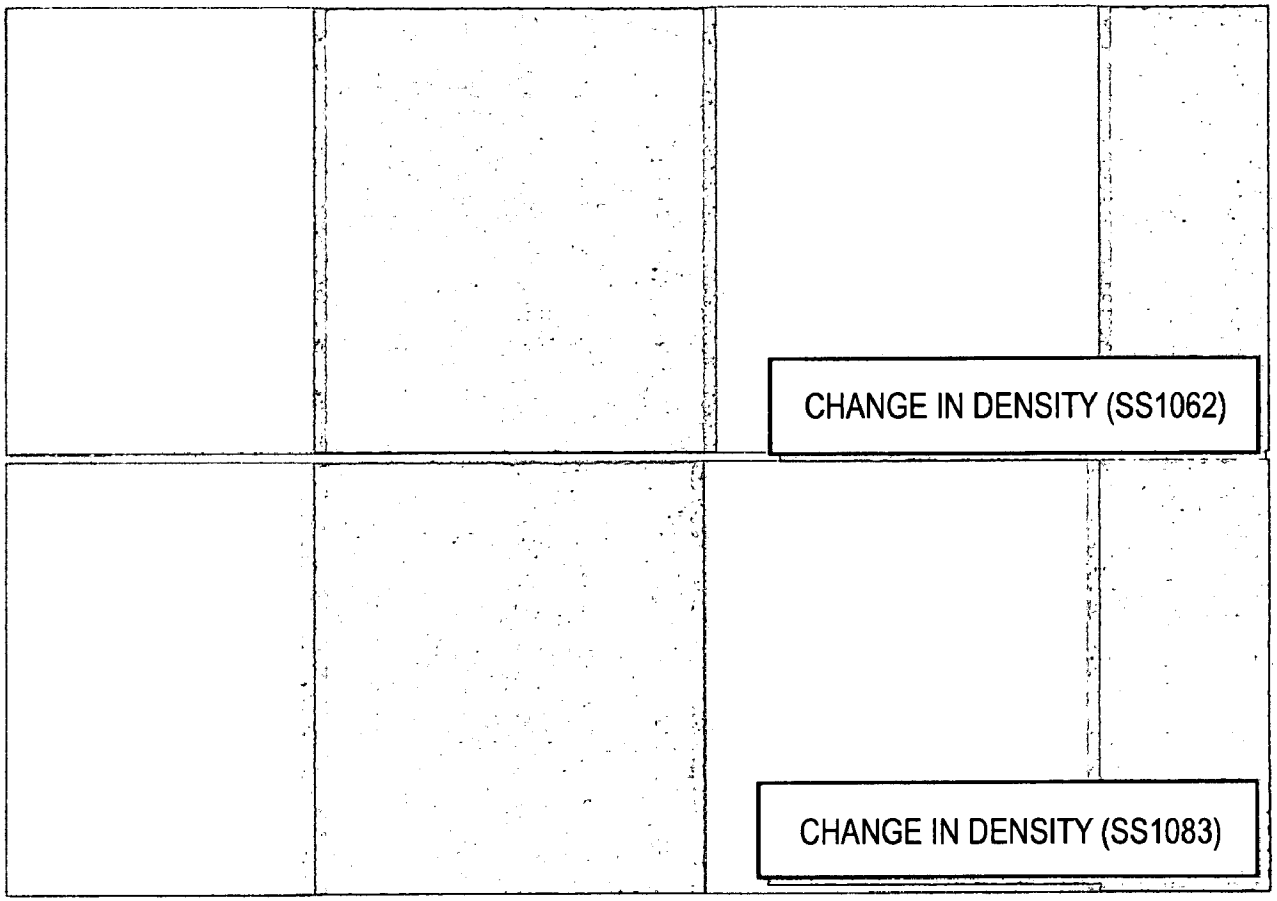
FIG. 16 is a diagram illustrating change in density between prototype Nos. "SS1062" and "SS1083" with lightness information alone.
Figure 17:
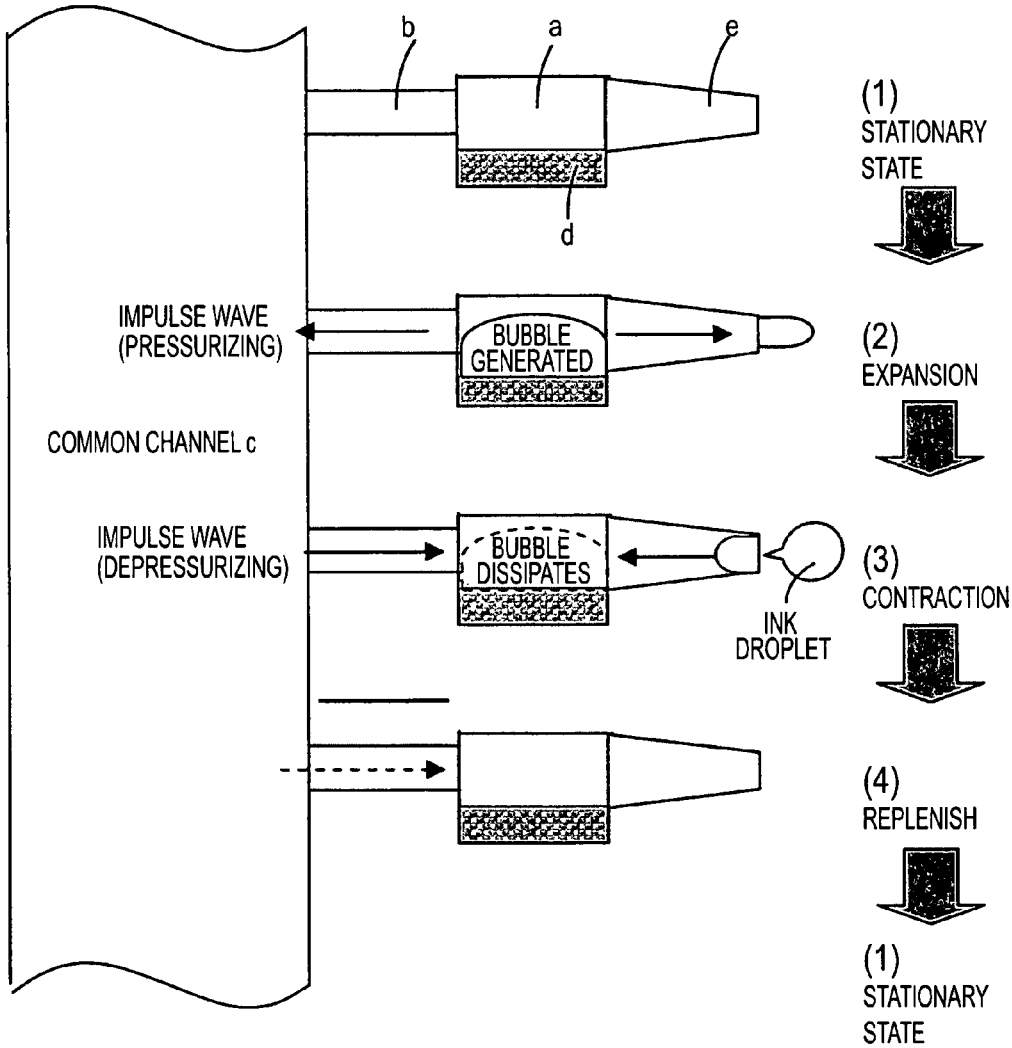
FIG. 17 is a diagram schematically illustrating the individual channels and common channel, and the ink liquid chamber, describing the actions at the time of discharging ink in time sequence.
Figure 18:
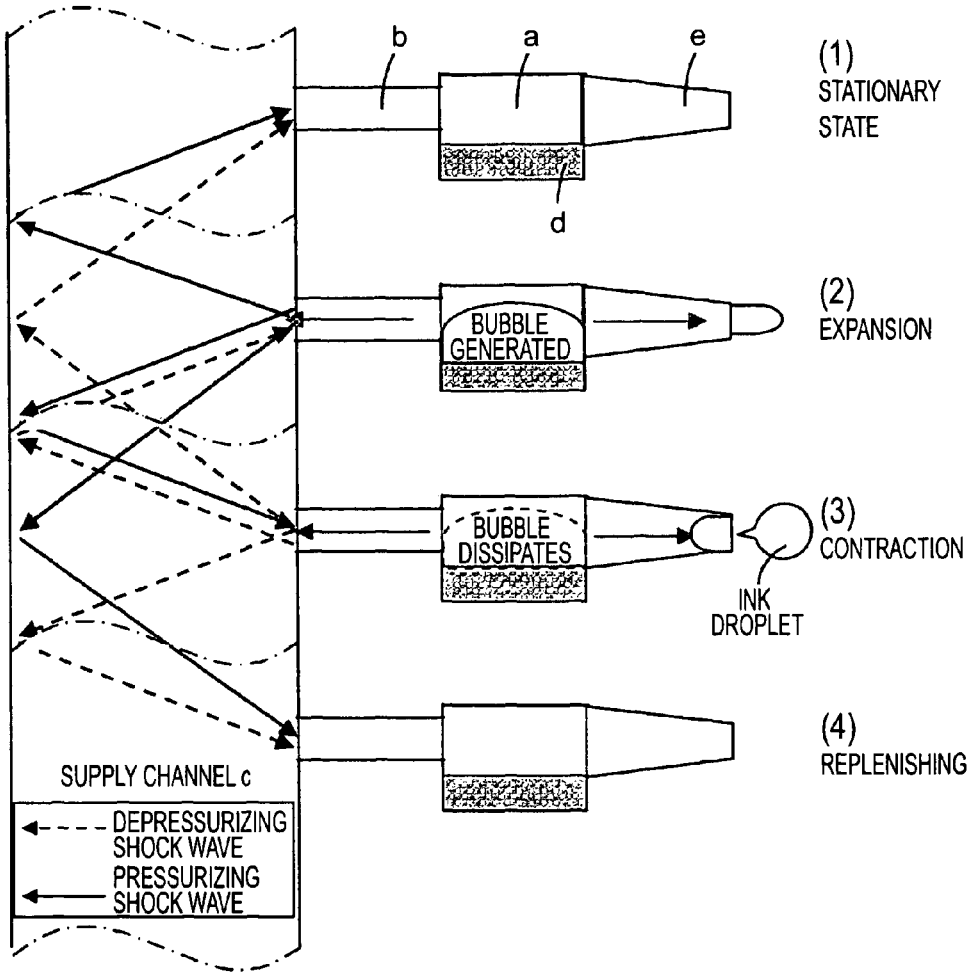
FIG. 18 is a diagram illustrating the mutual interference states of shock waves in the stationary, expansion, contraction, and replenishing states shown in FIG. 17.
Figure 19:
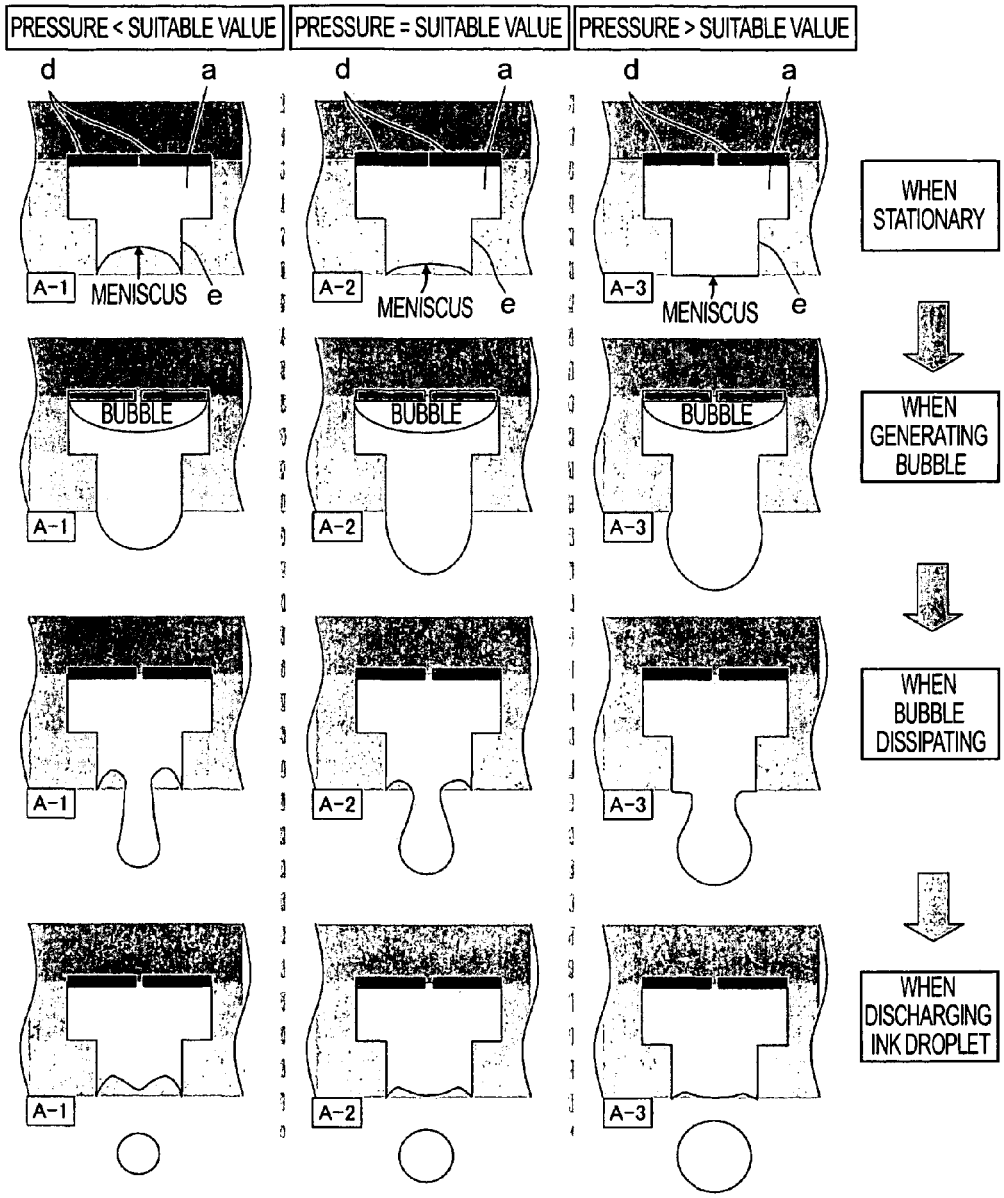
FIG. 19 is a diagram for describing the relation between the pressure within the ink liquid chamber and the discharged ink droplet.

Moreover, FIG. 15 is a graph illustrating the difference between prototype Nos. "SS1062" and "SS1083" according to difference in the horizontal common channel 32*c*. Further, FIG. 16 is a diagram illustrating change in density between prototype Nos. "SS1062" and "SS1083" with lightness information alone, in the same way as with FIG. 14. The reason that the improvement results shown in FIG. 15 seem smaller than those in FIG. 13 is due to the fact that the effects of improvement of the vertical common channel 32*d* are already included in the results in FIG. 15.

Also, while the horizontal common channel 32*c* used with the present embodiment has relatively small channel resistance, it can be clearly understood from FIG. 15 that even something of this level is effective, and it has been provided that further optimization of the structure of the pillars, the number of rows of the pillar, and so forth can, combined with the effects of the vertical common channel 32*d*, enable formation of a channel structure which is not readily affected by interference and pressure fluctuation which is the basic object of the present invention, both theoretically and practically.

While an embodiment of the present invention has been described, the present invention is not restricted to the above embodiment, and various modifications can be realized as follows.

(1) While heating elements 13 have been given as an example of thermal flying force supplying means, this is not restricted to heating elements 13, and other flying force supplying means may be used. Examples include electrostatic discharge means and piezoelectric flying force supplying means.

Electrostatic flying force supplying means are configured of a diaphragm and two electrodes disposed beneath the diaphragm with an air layer introduced therebetween. Voltage is applied between the electrodes, the diaphragm is flexed downwards, and subsequently the voltage is changed to 0 V so as to release electrostatic force. The elastic force of the diaphragm returning to the original state is used to discharge an ink droplet.

Also, with the piezoelectric flying force supplying means, a laminate of a piezo device having electrodes on both faces and a diaphragm is provided. Applying voltage to the electrodes on both faces of the piezo device generates bending moment due to piezoelectric effect, such that the diaphragm flexes and deforms. This deformation is used to discharge an ink droplet.

Thus, the present invention is not restricted to thermal methods, and can also be applied to piezo methods, electrostatic discharge methods, and the like. Also, as described above, the present invention can be applied regardless of serial or line printers. However, the present invention is for preventing shock of ink droplet discharge from affecting liquid discharge portions one another, so the stronger the pressure at the time of discharging ink droplets is, and the shorter the period is from one discharge to the next discharge (i.e., the faster the operating speed is), the greater the degree of effects is. Accordingly, thermal printers wherein the discharge force is strong (discharge speed is fast) and line printers wherein the period from one discharge to the next discharge is short (ink must be equally supplied to a great number of heads at high speed) benefit more from applying the present invention.

The invention claimed is:

1. A liquid discharge device having a liquid discharge head in which a plurality of liquid discharge portions are arrayed on a substrate, each of said liquid discharge portions comprising:

a liquid chamber for storing a liquid to be discharged, ejection force supplying means disposed within said liquid chamber, for providing the liquid within said liquid chamber with ejection force, and a nozzle for discharging the liquid stored in said liquid chamber by actions of said ejection force supplying means, said liquid discharge device further comprising:

individual channels, separated by barrier walls, provided for each of said liquid discharge portions so as to communicate with said respective liquid chamber and supply liquid to said respective liquid chamber, and a contiguous common channel disposed across each of said plurality of individual channels so as to communicate with each of said plurality of individual channels and for supplying liquid to said plurality of individual channels;

said contiguous common channel being comprised of:

a first common channel portion provided at a liquid supply source side, and a second common channel portion provided between said first common channel portion and said individual channels, and having liquid channel resistance greater than that of said first common channel portion, and further wherein the second common channel portion is in direct fluid communication with the individual channels, and the second common channel receives ink directly from the first common channel portion, wherein said second common channel portion is formed such that the channel resistance as to the movement direction of liquid to the plurality of individual channels with which said second common channel portion communicates is substantially constant.

2. The liquid discharge device according to claim 1, wherein the channel cross-sectional area of said second common channel portion perpendicular to a supply direction of said liquid through said second common channel portion is formed smaller than the channel cross-sectional area of said first common channel portion perpendicular to a supply direction of said liquid through said first common channel portion, thereby setting the channel resistance of said second common channel portion greater than the channel resistance of said first common channel portion.

3. The liquid discharge device according to claim 2, wherein a flow direction of liquid in the entire length of the second common channel portion is perpendicular to a flow direction of liquid in said individual channels.

4. The liquid discharge device according to claim 2, wherein a flow direction of liquid in a first part of the second common channel portion is perpendicular to a flow direction of liquid in said individual channels, and a flow direction of liquid in a second part of the second common channel portion is parallel to a flow direction of liquid in said individual channels.

5. The liquid discharge device according to claim 4, wherein pillars are formed in said second part of said second common channel portion but not in said first part of said second common channel portion.

6. The liquid discharge device according to claim 1, wherein at least a part of said second common channel portion is comprised of at least a part of said liquid discharge head.

7. The liquid discharge device according to claim 1, wherein a plurality of said liquid discharge heads are provided, and said second common channel portion of said plurality of said liquid discharge heads is formed so as to have substantially constant channel resistance.

8. The liquid discharge device according to claim 1, wherein said second common channel portion is formed so as to have generally the same channel flow direction as said individual channels.

9. The liquid discharge device according to claim 1, wherein at least a part of a wall comprising said second common channel portion is a face of said substrate where said individual channels are provided.

10. The liquid discharge device according to claim 1, wherein at least a part of a wall comprising said second common channel portion is said substrate where said individual channels are provided, and further is formed of a same material as the material comprising said liquid discharge portions or said individual channels.

11. The liquid discharge device according to claim 1, wherein said substrate has a face perpendicular to or generally perpendicular to a face where said individual channels are provided, and at least a part of a wall comprising said second common channel portion is said perpendicular or generally perpendicular face.

12. The liquid discharge device according to claim 1, wherein at least a part of a wall comprising said second common channel portion is a face of said substrate where said individual channels are provided, and wherein said substrate has a face perpendicular to or generally perpendicular to a face where said individual channels are provided, with at least a different part of a wall comprising said second common channel portion is said perpendicular or generally perpendicular face.

13. The liquid discharge device according to claim 1, wherein pillars are formed in said second common channel portion.

14. The liquid discharge device according to claim 1, wherein a flow direction of liquid in the entire length of the second common channel portion is perpendicular to a flow direction of liquid in said individual channels.

15. The liquid discharge device according to claim 1, wherein a flow direction of liquid in a first part of the second common channel portion is perpendicular to a flow direction of liquid in said individual channels, and a flow direction of liquid in a second part of the second common channel portion is parallel to a flow direction of liquid in said individual channels.

16. The liquid discharge device according to claim 15, wherein pillars are formed in said second part of said second common channel portion but not in said first part of said second common channel portion.

17. The liquid discharge device according to claim 1, wherein the second common channel portion is comprised of a portion that is located on the same substrate on which the barrier walls are formed for the individual channels and a height of the individual channels is greater than a height of the second common channel portion.

* * * * *